US008768213B2

(12) United States Patent
Akutsu et al.

(10) Patent No.: US 8,768,213 B2
(45) Date of Patent: Jul. 1, 2014

(54) IMAGE FORMING APPARATUS

(75) Inventors: Takashi Akutsu, Odawara (JP); Tsutomu Nishiuwatoko, Numazu (JP); Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 132 days.

(21) Appl. No.: 13/312,666

(22) Filed: Dec. 6, 2011

(65) Prior Publication Data

US 2012/0148294 A1 Jun. 14, 2012

(30) Foreign Application Priority Data

Dec. 10, 2010 (JP) ..... 2010-276168

(51) Int. Cl.
*G03G 15/04* (2006.01)
*G03G 21/16* (2006.01)
*G03G 21/18* (2006.01)

(52) U.S. Cl.
CPC ..... *G03G 21/1821* (2013.01); *G03G 21/1633* (2013.01); *G03G 21/1853* (2013.01)
USPC ..... 399/119; 399/116; 399/121

(58) Field of Classification Search
CPC G03G 15/0896; G03G 21/16; G03G 21/1853
USPC ..... 399/111, 112, 114, 119, 222
See application file for complete search history.

(56) References Cited

U.S. PATENT DOCUMENTS 7,356,283 B2 4/2008 Igarashi
2010/0221039 A1* 9/2010 Kawai et al. ..... 399/121

* cited by examiner

*Primary Examiner* — Walter L Lindsay, Jr.
*Assistant Examiner* — Barnabas Fekete
(74) *Attorney, Agent, or Firm* — Canon USA Inc. IP Division

(57) ABSTRACT

A guide surface of an attachment guide for a cartridge attached to a position nearest to a scanner has, in the vicinity of an inlet of the attachment guide, a portion oriented so as to be away from a guide surface of a guide unit for another cartridge from the upstream toward the downstream side in the direction in which the cartridges are attached.

10 Claims, 39 Drawing Sheets

IMAGE FORMING APPARATUS

BACKGROUND OF THE INVENTION

1. Field of the Invention

The present invention relates to an image forming apparatus in which a cartridge is detachably attached to an apparatus main body and in which an image is formed on a recording medium.

2. Description of the Related Art

As an image forming apparatus, there exists an electrophotographic image forming apparatus. Here, the electrophotographic image forming apparatus forms an image on a recording medium by employing an electrophotographic image forming process. Examples of the electrophotographic image forming apparatus include an electrophotographic copying machine, an electrophotographic printer (e.g., a laser beam printer and a light-emitting diode (LED) printer), a facsimile apparatus, and a word processor. The recording medium is a medium on which an image is formed by an electrophotographic image forming apparatus; examples of the recording medium include paper and an overhead transparency (OHT) sheet.

Regarding the above-mentioned electrophotographic image forming apparatus, there has been discussed a construction in which a scanner unit serving as an exposure unit is mounted on a cover member that opens and closes an opening for attaching and detaching a plurality of cartridges. According to the discussed construction, the scanner unit is retracted when the cover member is opened for attachment/detachment of the cartridges, thereby achieving an improvement in terms of operability in the attachment/detachment of the cartridges (see U.S. Pat. No. 7,356,283). Further, in this connection, as a result of the recent reduction in the size of image forming apparatuses, there has been generated a requirement to suppress the height or the size in the width direction of the image forming apparatus. Thus, in an image forming apparatus of the type which uses a plurality of cartridges, the distance between the cartridges is becoming smaller and smaller.

U.S. Pat. No. 7,356,283 discusses an image forming apparatus capable of color image formation. In this image forming apparatus, a plurality of cartridges are adjacent to each other obliquely up and down. In the image forming apparatus discussed in U.S. Pat. No. 7,356,283, the scanner unit is mounted on the cover member, so that the scanner unit is retracted when the cover member is opened, thus facilitating the attachment/detachment of the cartridges.

However, since the scanner unit is mounted on the cover member, the cover member is so much the thicker; in the image forming apparatus as discussed in U.S. Pat. No. 7,356,283, if an attempt is to be made to reduce the height of the apparatus main body, a part of the opening for the attachment/detachment of the cartridges has to be stopped.

Thus, when attaching/detaching a cartridge to the attachment position nearest to the scanner unit, with the cover member being open, the scanner unit may hinder smooth attachment/detachment of the cartridge.

Thus, the scanner unit mounted on the cover member may constitute an obstacle to a reduction in the size of the apparatus main body.

Even if the scanner unit is not mounted on the cover member, there might be cases where the attachment/detachment of the cartridge to/from the attachment position nearest to the cover member is rather difficult to perform with the cover member being open.

SUMMARY OF THE INVENTION

The present invention is directed to an image forming apparatus in which a plurality of cartridges are adjacent to each other, wherein a reduction in apparatus size and smooth attachment/detachment of the cartridges are compatible with each other.

According to an aspect of the present invention, an image forming apparatus allowing attachment/detachment of a plurality of cartridges for forming images includes a plurality of guide units configured to guide the plurality of cartridges to their respective attachment positions for attachment/detachment of the plurality of cartridges, and a cover member capable of assuming a closed position where an opening for the attachment/detachment of the plurality of cartridges is closed and an open position where the opening is open, thus allowing the attachment/detachment of the plurality of cartridges, wherein the plurality of cartridges are arranged in one direction so as to be adjacent to each other, and wherein, when the cover member is at the open position, a guide surface of the guide unit for the cartridge to be attached to a position nearest to the cover member in the direction in which the cartridges are adjacent to each other has, in the vicinity of an inlet portion of the guide unit on the upstream side in the cartridge attaching direction, a portion oriented so as to be away from a guide surface of the guide unit for another cartridge from the upstream toward the downstream side in the cartridge attaching direction, in the direction in which the cartridges are adjacent to each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Unless otherwise specified, the dimensions, materials, configurations, and the relative arrangement of the components described in connection with exemplary embodiments of the present invention should not construed restrictively.

Figure 1A:
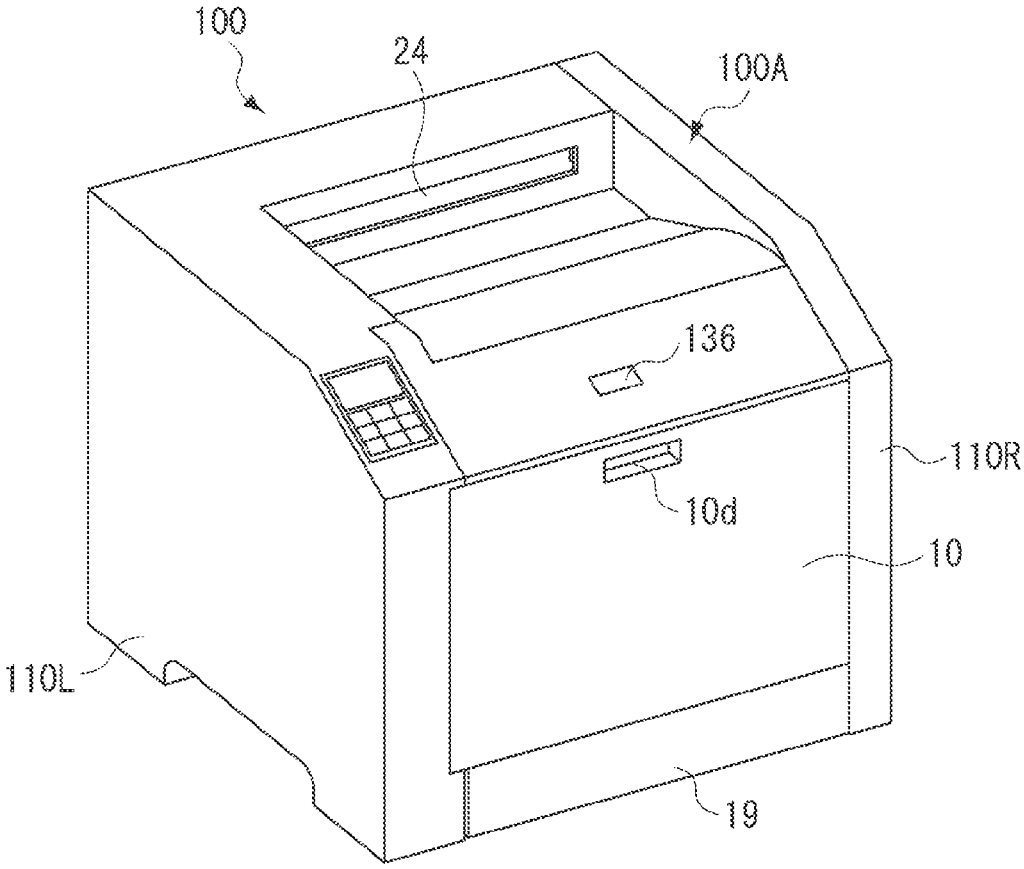
FIG. 1A is an external perspective view of an image forming apparatus according to a first exemplary embodiment of the present invention.
Figure 1B:
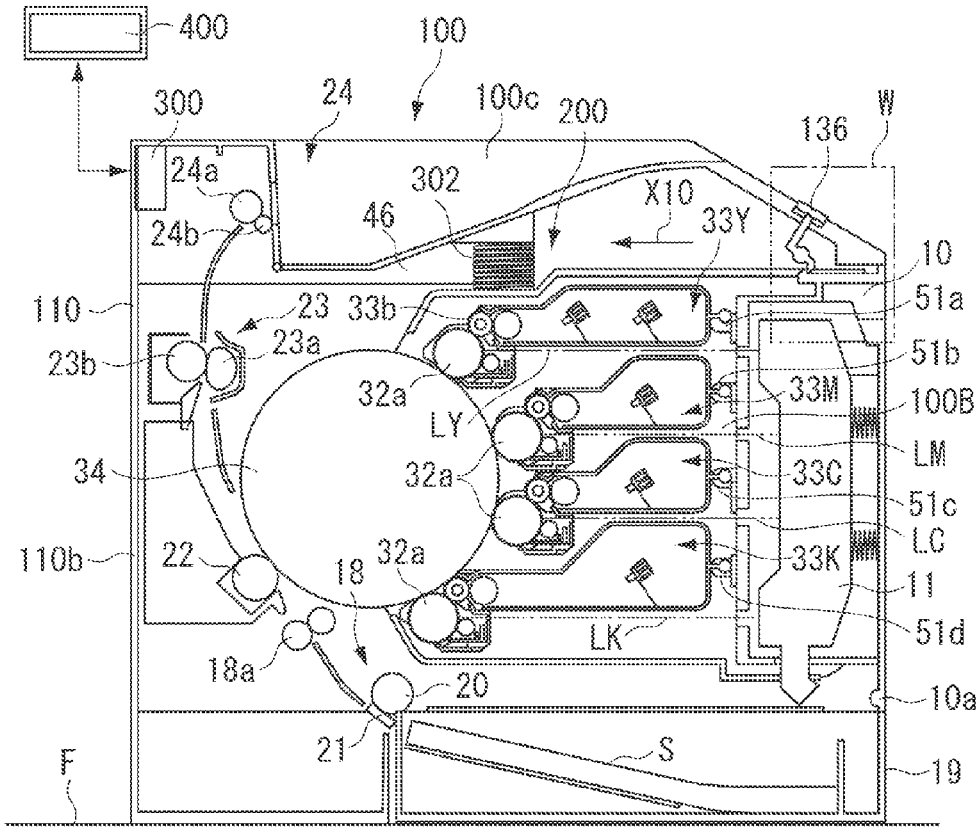
FIG. 1B is a left-hand side longitudinal sectional view of the image forming apparatus.

FIG. 1A is an external perspective view of an electrophotographic image forming apparatus (hereinafter referred to as the image forming apparatus) 100 according to a first exemplary embodiment of the present invention. FIG. 1B is a left-hand side longitudinal sectional view of the image forming apparatus 100. The image forming apparatus 100 is a full four-color laser printer employing the electrophotographic process.

The image forming apparatus 100 forms a full color image on a recording medium (sheet) S based on an electric image signal input to a control circuit unit 300 from an external host apparatus 400 such as a personal computer, an image reader, or an associated facsimile apparatus.

In the following description, regarding the image forming apparatus 100, the front side thereof is oriented in the direction in which a feeding cassette 19 accommodating recording media S stacked together is pulled into and out of an apparatus main body 100A. The rear side is opposite that side. The upper side is the side on which the recording media S are discharged. The longitudinal direction implies both the direction from the rear toward the front side (forward direction) and the opposite direction (backward direction). The right-hand and left-hand sides are the right-hand and left-hand sides as seen from the front side of the image forming apparatus. The horizontal direction implies both the direction from the right-hand toward the left-hand side (leftward direction) and the opposite direction (rightward direction). The axes of electrophotographic photosensitive drums and developing rollers extend in the longitudinal direction. The apparatus main body 100A is the portion of the image forming apparatus excluding cartridges (33Y, 33M, 33C, and 33K) and an image forming unit 200. In the image forming apparatus according to the present exemplary embodiment, the right-hand side is the driving side, and the left-hand side is the non-driving side.

Figure 2:
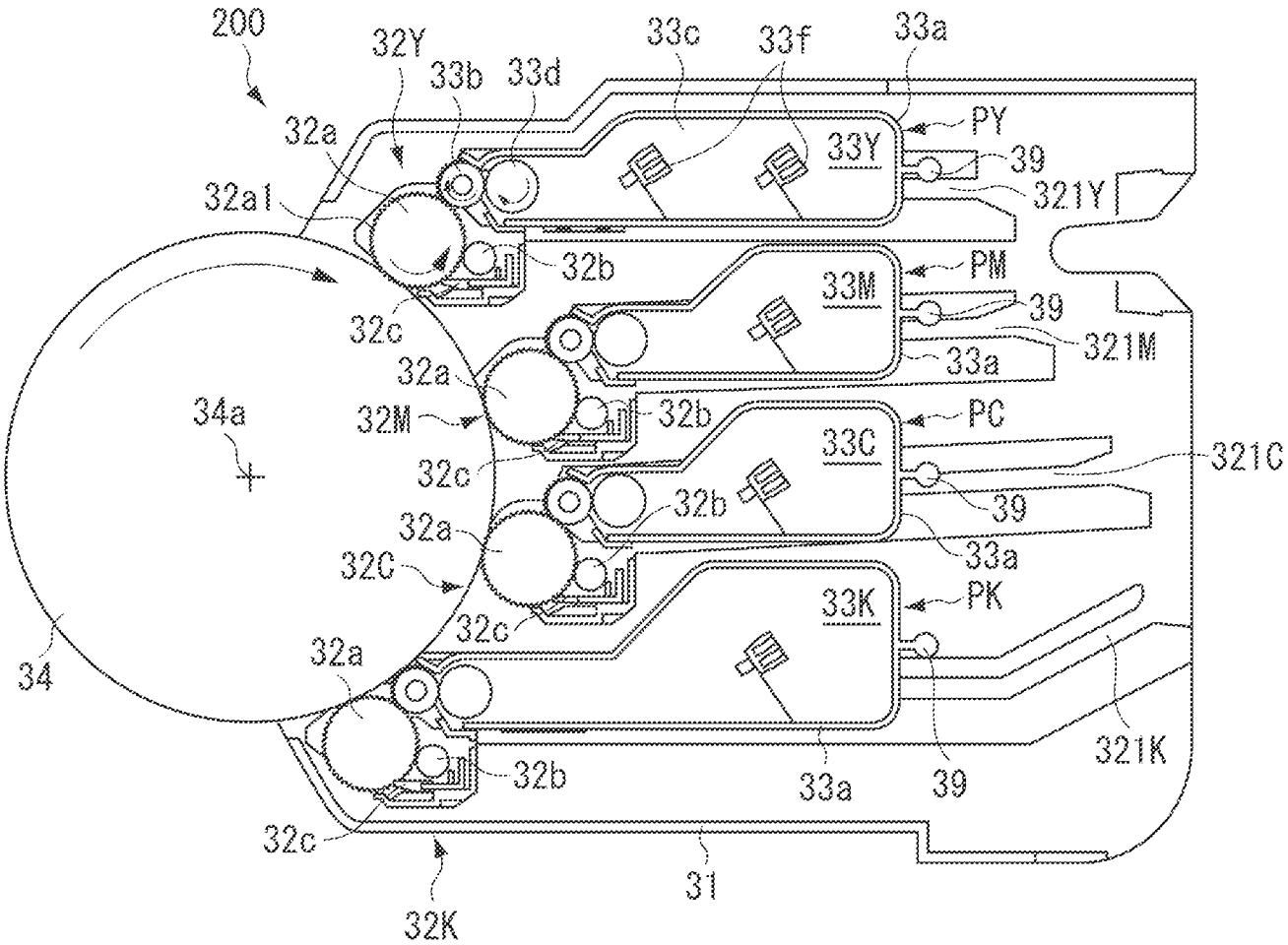
FIG. 2 is an enlarged view of an image forming unit portion in FIG. 1B.

The image forming apparatus 100 is placed on a substantially horizontal installation plane F of a placing base, desk, floor or the like. FIG. 2 is an enlarged view of the image forming unit 200 in FIG. 1B. The unit 200 has a sub frame 31 detachable with respect to a main frame 110 of the apparatus main body 100A. Further, the unit 200 has, on the sub frame 31, cartridge attachment units (guide units) 321 (321Y, 321M, 321C, and 321K), and a single intermediate transfer member (transfer member) 34. The cartridge attachment units (guide units) 321 serve to attach the plurality of cartridges, which, in the present exemplary embodiment, are the first through fourth developing cartridges 33 (33Y, 33M, 33C, and 33K), so as to allow them to be detached. In the present exemplary embodiment, an electrophotographic photosensitive drum 32*a* to which each developing cartridge 33 corresponds is mounted on the unit 200 along with a charging roller 32*b* and a cleaning blade 32*c*. The charging roller 32*b* and the cleaning blade 32*c* are process units. In the image forming apparatus 100, the plurality of cartridges 33 are detachably attached to the apparatus main body 100A (the unit 200), and a color image is formed on a recording medium S. The construction of the unit 200 will be described in more detail below. In the present exemplary embodiment, the developing cartridges 33 differ in the colors of developers (toners) accommodated therein; further, in the developing cartridge 33K, in particular, which accommodates black developer, the volume of a developer accommodating portion 33*c* is larger than that of the developing cartridges accommodating developers of other colors. This, however, should not be construed restrictively. For example, the developing cartridges maybe of the same construction except that the colors of the developers (toners) accommodated therein differ from each other. Further, while in the present exemplary embodiment the cartridges are developing cartridges, this should not be construed restrictively. For example, the drum 32*a*, the charging roller 32*b*, and the cleaning blade 32*c*, which are mounted on the unit 200 in the present exemplary embodiment, may be mounted on the developing cartridge 33. In the case of this construction, the cartridge is referred to as a process cartridge instead of the developing cartridge. For, in this case, the drum 32*a* and the charging roller 32*b*, the developing roller 33*b*, and the cleaning blade 32*c* as the process units are integrated into a cartridge, which is detachably attached to the apparatus main body 100A.

Each photosensitive drum 32*a* is mounted on the sub frame 31 of the image forming unit 200 so as to be rotatable around the axis of the photosensitive drum 32*a*. Further, as process units acting on the drum 32*a*, there are provided the charging roller 32*b*, and the cleaning blade 32*c* configured to remove the developer remaining on the surface of the drum 32*a*. The drum 32*a*, the charging roller 32*b*, and the cleaning blade 32*c* are mounted so as to be in a predetermined arrangement relationship.

As illustrated in FIG. 2, each cartridge 33 (33Y, 33M, 33C, 33K) has a case 33*a*, and a developing roller 33*b* for supplying developer to the drum 32*a*, that is, for developing an electrostatic latent image formed on the drum 32*a* into a developer image. Further, the cartridge 33 has a developer accommodating portion 33*c* accommodating developer used for the development of the electrostatic latent image, and a supply roller 33*d* configured to supply the developer in the developer accommodating portion 33*c* to the developing roller 33*b*. Further, the developer accommodating portion 33*c* is provided with a conveyance member 33*f* for conveying the developer therein to the supply roller 33*d*.

In the present exemplary embodiment, a plurality of cartridges 33 (33Y, 33M, 33C, and 33K) are arranged in one direction (in the vertical direction in the present exemplary embodiment) so as to be adjacent to each other. In the first cartridge 33Y, yellow (Y) developer is accommodated in the developer accommodating portion 33*c*, and a Y-color developer image is formed on the surface of the corresponding drum 32*a*. In the second cartridge 33M, magenta (M) developer is accommodated in the developer accommodating portion 33*c*, and an M-color developer image is formed on the surface of the corresponding drum 32*a*. In the third cartridge 33C, cyan (C) developer is accommodated in the developer accommodating portion 33*c*, and a C-color developer image is formed on the surface of the corresponding drum 32*a*. In the fourth cartridge 33K, black (K) developer is accommodated in the developer accommodating portion 33*c*, and a K-color developer image is formed on the surface of the corresponding drum 32*a*.

Figure 3A:
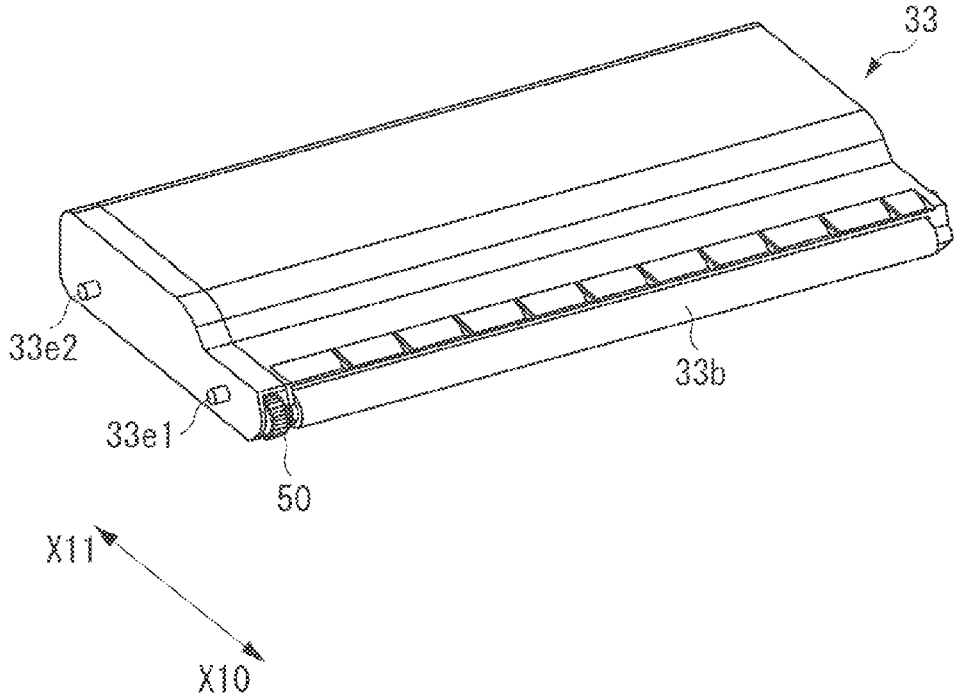
FIG. 3A is a right rear side perspective view of a first cartridge according to the first exemplary embodiment.
Figure 3B:
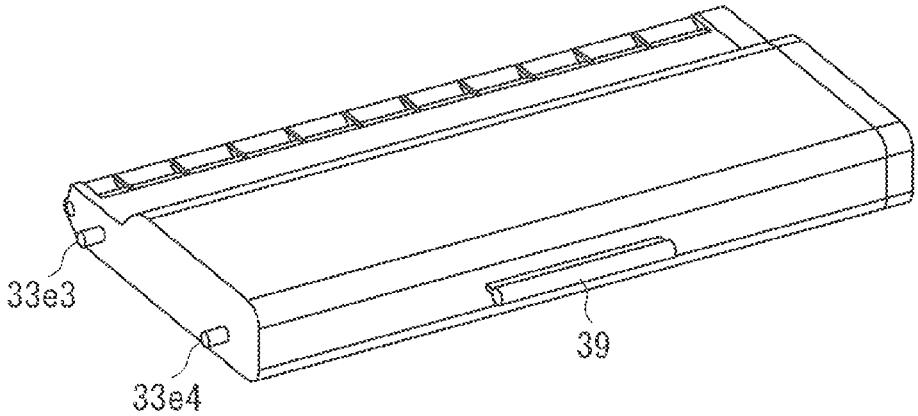
FIG. 3B is a left front side perspective view of the first cartridge according to the first exemplary embodiment.

FIG. 3A is a perspective view of the cartridge 33Y as seen from the right-hand rear side, and FIG. 3B is a perspective view of the same as seen from the left-hand front side. As a representative of the cartridges 33, this cartridge 33Y will be described. The cartridge 33Y is attached to an attachment portion 321Y of the unit 200 in the direction of the arrow X10. The cartridge 33Y is detached from the attachment portion 321Y of the unit 200 in the direction of the arrow X11, which is the opposite of the arrow X10. It should be noted that, in the present exemplary embodiment, the attachment/detachment direction of the fourth cartridge 33K differs from that of the other cartridges (33Y, 33M, and 33C). The attachment/detachment of the cartridge 33K will be described in detail below.

The cartridge 33Y has the developing roller 33*b* at the forward end side in the attaching direction. At the right-hand end of the developing roller 33*b*, there is provided a gear 50, which receives a driving force from a drum gear 32*a*1 to rotate the developing roller 33*b*. Further, the gear 50 transmits drive to the supply roller 33*d* and the conveyance member 33*f* via a gear row (not illustrated).

At the right-hand end and the left-hand end of the cartridge 33Y, there are provided guided portions 33*e*1, 33*e*2, 33*e*3, and 33*e*4 to be guided by the unit 200 when the cartridge 33Y is attached to the unit 200. The guided portions 33*e*1, 33*e*2, 33*e*3, and 33*e*4 are of a columnar configuration, and protrude outwardly from the right-hand end and the left-hand end of the cartridge 33Y.

The guided portions 33*e*1 and 33*e*3 are situated nearer to the developing roller 33*b* than the guided portions 33*e*2 and 33*e*4. On the opposite side of the developing roller 33*b* of the cartridge 33Y, there is provided a grip portion 39 (see FIG. 2) for grasping the cartridge 33Y. By grasping the grip portion 39, the user can perform the attachment/detachment of the cartridge 33Y with respect to the unit 200. Each of the other cartridges 33M, 33C, and 33K also has a grip portion 39, grasping of which allows attachment/detachment with respect to the unit 200.

Figure 5A:
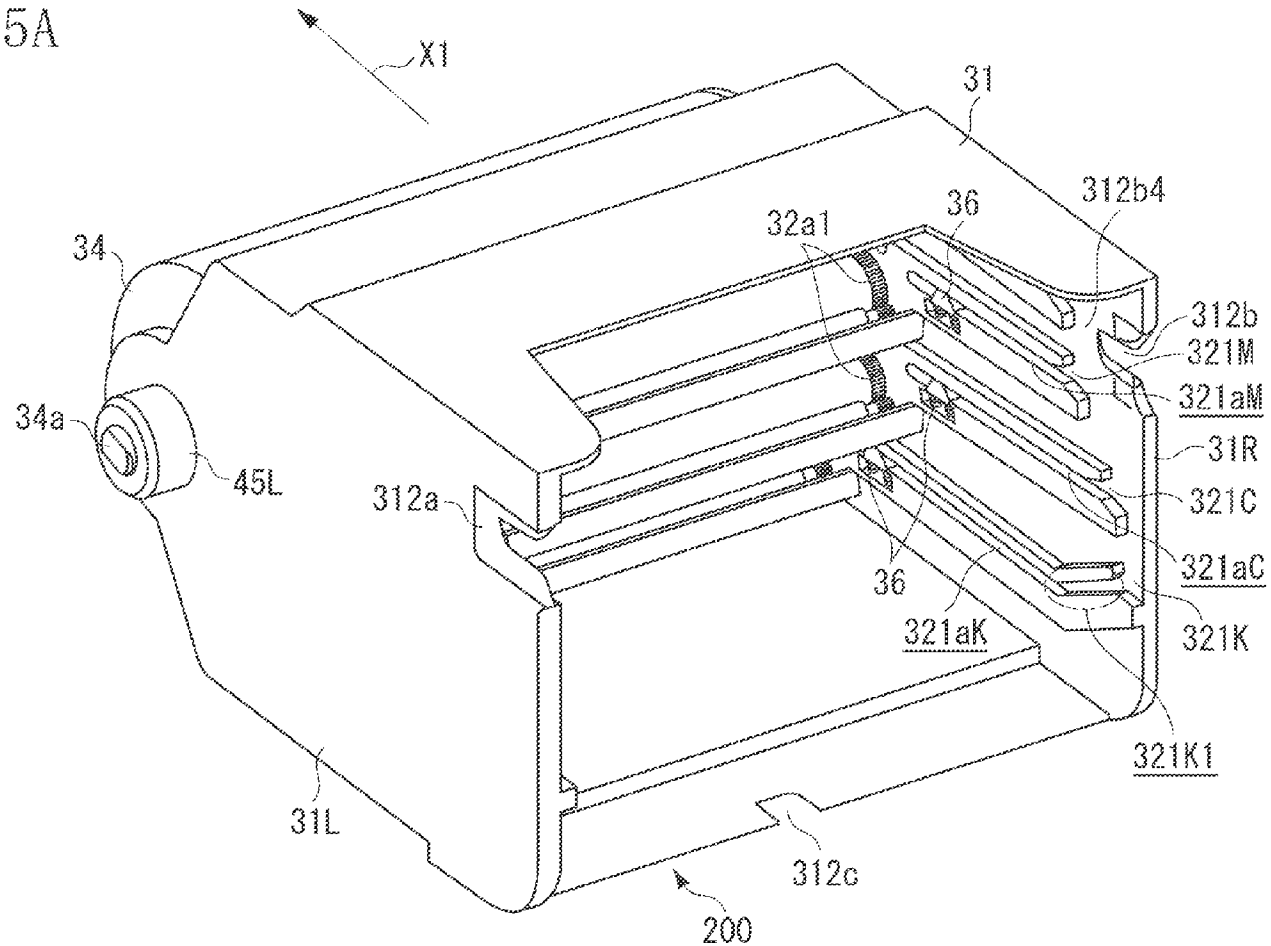
FIG. 5A is a left-hand side perspective view of an image forming unit according to the first exemplary embodiment.

As illustrated in FIG. 5A, in the present exemplary embodiment, the intermediate transfer member 34 is a columnar drum extending horizontally along the axis of the rotation center 34*a* thereof and arranged horizontally so as to be rotatable around the axis thereof. As illustrated in FIG. 1B, on the front side of the intermediate transfer member 34, the cartridges 33 are arranged so as to be substantially parallel to the installation surface F of the apparatus main body 100A, and sequentially adjacent to each other in the vertical direction. In the image forming apparatus according to the present exemplary embodiment, the first cartridge 33Y is at the uppermost stage, and the second cartridge 33M is situated under the same. Further, the third cartridge 33C is situated under the second cartridge. The fourth cartridge 33K is at the lowermost stage.

Figure 4:
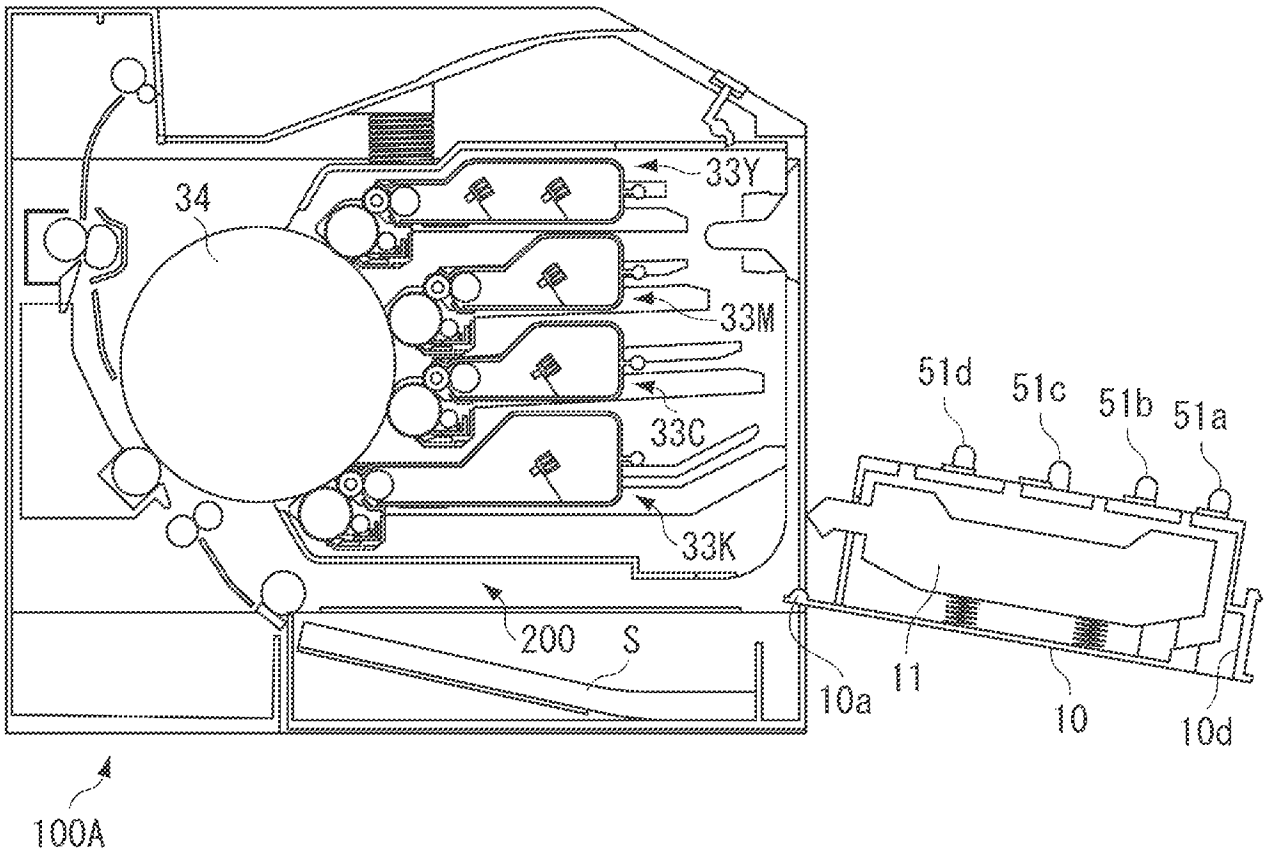
FIG. 4 is a left-hand side longitudinal sectional view of the image forming apparatus when a cover unit according to the first exemplary embodiment is at an open position.

The apparatus main body 100A is provided with a cover unit 10, which is a cover member for opening and closing an opening 100B (FIG. 6A) allowing attachment of the cartridges 33; a laser scanner unit 11, which is an exposure unit, is mounted on the cover unit 10. As illustrated in FIG. 4, the cover unit 10 is configured to be opened downwardly.

The developing roller 33*b* of each cartridge 33 employs a non-contact type developing system, in which it is spaced away from the drum 32*a* with a predetermined small gap (of a fixed width) therebetween. However, this should not be construed restrictively; it is also possible to adopt a contact type developing system, in which the developing roller 33*b* of each cartridge 33 is held in contact with the drum 32*a*.

The apparatus main body 100A has cartridge urging members 51*a* through 51*d* (FIGS. 4 and 6B) configured to urge the cartridges 33 toward the corresponding photosensitive units 32. The urging members 51*a* through 51*d* are provided at both ends in the longitudinal direction (the right-to-left direction) of the cartridges 33, with each cartridge 33 being provided with two of them. The urging members 51*a* through 51*d* are provided on the cover unit 10, and are brought successively into contact with the rear end portions of the cartridges 33 in conjunction with the operation of fastening the cover unit 10. As illustrated in FIG. 1B, when the unit 200 is situated at the image forming position, the cartridges 33 are urged in the direction of the arrows P (PY, PM, PC, and PK) by the urging members 51*a* through 51*d*.

Regulation runners (not illustrated) provided at both ends of the developing roller 33*b* contained in each cartridge 33 are brought into contact with the drum 32*a*, whereby the developing roller 33*b* is held in contact with the drum 32*a* with a fixed urging force. The urging force due to the urging members 51*a* through 51*d* maintains a satisfactory separation state (or contact state) between the developing rollers 33*b* and the drums 32*a*.

As illustrated in FIG. 1B, on the front side of the cartridges 33, there is arranged a laser scanner unit 11 as an image exposure device. The unit 11 has a laser diode, a polygon mirror, an Fθ lens, a reflector mirror, etc. The unit 11 outputs laser beams L (LY, LM, LC, and LK) modulated in correspondence with image information of the colors of Y, M, C, and K input to a control circuit unit 300 from an external host apparatus 400, performing scanning exposure on the drums 32*a* of the cartridges 33 of the corresponding colors.

Here, the laser scanner unit 11 serving as the exposure unit is mounted on the cover unit 10, which is a cover member. When the cover unit 10 is at the closed position, the laser scanner unit 11 assumes a position to perform exposure, and when the cover unit 10 is at the open position, it assumes a position retracted from the opening 100B.

As illustrated in FIG. 1B, a feeding unit 18 is arranged in the lower portion of the image forming unit 200. The feeding unit 18 has a feeding cassette 19 accommodating the recording media S in a stacked state, a feeding roller 20, a separation pad 21, etc. The feeding cassette 19 can be put into and out of (attached to and detached from) the apparatus main body 100A via the front side thereof (front loading). Further, in the apparatus main body 100A, a recording medium conveyance path leading from the feeding roller 20 to the upper rear side portion of the apparatus main body 100A is formed between the intermediate transfer member 34 and a rear side frame 110*b* of the apparatus main body 100. A registration roller pair 18*a*, a secondary transfer roller 22, a fixing device 23, and a discharge roller pair 24 are arranged from below along this conveyance path. The fixing device 23 includes a fixing film unit 23*a* and a pressing roller 23*b*. The discharge roller pair 24 includes a discharge roller 24*a* and a discharge runner 24*b*. On the upper surface of the apparatus main body 100A, there is arranged a discharge tray 100*c* configured to receive the recording media that have undergone image formation.

The cover unit 10 is an opening/closing member capable of opening and closing the opening 100B (see FIG. 6) provided in the front surface of the apparatus main body 100A. The laser scanner unit 11 is mounted on the cover unit 10. As described below, the opening 100B is an opening allowing the attachment/detachment of the cartridges 33 with respect to the unit 200. Thus, by bringing the cover unit 10 holding the unit 11 to the open position, the cartridges 33 can be attached and detached.

FIG. 1B illustrates a state in which the image forming apparatus 100 can conduct image forming operation.

In this state, the cover unit 10 is placed at the closed position where it closes the opening 100B. The unit 200 with the cartridges 33 attached thereto is situated at the image forming position, with respect to the apparatus main body, where it performs image formation. A drive output unit (not illustrated) provided on the apparatus main body 100A side is connected to a gear 34*b* (FIG. 5C), which is a drive input unit for the intermediate transfer member 34 of the unit 200. Further, a power supply system (not illustrated) provided on the apparatus main body 100A side is electrically continuous with the electrical contacts (not illustrated) between the drum 32*a*, the charging roller 32*b*, etc., and the cartridge 33. Here, as the above-mentioned drive system and bias application system, which are omitted in the diagrams for the sake of simplicity, it is possible to adopt a construction that is the same as that of an ordinary image forming apparatus.

Referring to FIGS. 1B and 2, the operation of forming a full-color image will be described.

The drums 32*a* are rotated counterclockwise as indicated by the arrow at a predetermined speed. The charging rollers 32*b* are driven to rotate through the rotation of the drums 32*b*. Further, the intermediate transfer member 34 is rotated clockwise as indicated by the arrow (in the forward direction with respect to the rotation of the drums 32*a*) at a speed corresponding to the speed of the drums 32*a*. Further, the developing rollers 33*b* and the supply rollers 33*d* are rotated clockwise as indicated by the arrows at a predetermined speed. The scanner unit 11 is also driven. In synchronism with this driving, a predetermined charging bias is applied to each charging roller 32*b* with a predetermined control timing.

As a result, the surfaces of the drums 32*a* are uniformly charged by the charging rollers 32*b* to a predetermined polarity and potential. The scanner unit 11 performs scanning exposure on the surfaces of the drums 32*a* with laser beams L (LY, LM, LC, and LK) modulated according to corresponding image signals of the Y, M, C, and K colors. As a result, an electrostatic latent image according to the image signal of the corresponding color is formed on the surface of each drum 32*a*. Then, the electrostatic latent image formed on the surface of each drum 32*a* is developed into a developer image by the developing roller 33*b* of the corresponding cartridge 33. A predetermined developing bias is applied to each developing roller 33*b* with a predetermined control timing.

Through the above electrophotographic image forming process operation, a Y-color developer image corresponding to the Y-color component of the full color image is formed on the drum 32*a* located opposite the cartridge 33Y. Then, the developer image is primarily transferred onto the intermediate transfer member 34 at a primary transfer nip portion, which is a contact portion between the drum 32*a* and the intermediate transfer member 34. An M-color developer image corresponding to the M-color component of the full color image is formed on the drum 32*a* located opposite the cartridge 33M. Then, the developer image is primarily transferred onto the intermediate transfer member 34 at a primary transfer nip portion, which is a contact portion between the drum 32*a* and the intermediate transfer member 34, so as to be superimposed on the Y-color developer image already transferred onto the intermediate transfer member 34. A C-color developer image corresponding to the C-color component of the full color image is formed on the drum 32*a* located opposite the cartridge 33C. Then, the developer image is primarily transferred onto the intermediate transfer member 34 at a primary transfer nip portion, which is a contact portion between the drum 32*a* and the intermediate transfer member 34, so as to be superimposed on the Y-color and M-color developer images already transferred onto the intermediate transfer member 34. A K-color developer image corresponding to the K-color component of the full color image is formed on the drum 32*a* located opposite the cartridge 33K. Then, the developer image is primarily transferred onto the intermediate transfer member 34 at a primary transfer nip portion, which is a contact portion between the drum 32*a* and the intermediate transfer member 34, so as to be superimposed on the Y-color/M-color/C-color developer images already transferred onto the intermediate transfer member 34. In this way, there is formed through synthesis a full color unfixed developer image of the four colors of Y, M, C, and K on the intermediate transfer member 34.

The order in which the developer images are successively transferred onto the intermediate transfer member 34 so as to be superimposed one upon the other is not restricted to the above-mentioned one. The transfer residual developer remaining on the surface of each drum 32*a* after the primary transfer of the developer image to the intermediate transfer member 34 is removed by the cleaning blade 32*c*, and is collected in each waste developer accommodating portion.

On the other hand, the feeding roller 20 is driven with a predetermined control timing. As a result, through cooperation of the feeding roller 20 and the separation pad 21, the recording media S in the form of sheets stacked together and accommodated in the feeding cassette 19 are fed separately one by one. Then, each recording medium S is introduced into a secondary transfer nip portion, which is a contact portion between the intermediate transfer member 34 and the secondary transfer roller 22 by the registration roller pair 18*a* with a predetermined control timing. A secondary transfer bias of a polarity opposite to the charging polarity of the developer and of a predetermined potential is applied to a secondary transfer roller 22 with a predetermined control timing. As a result, the four-color developer images superimposed one upon the other on the intermediate transfer member 34 are secondarily transferred to the surface of the recording medium S as the recording medium S is conveyed through the secondary transfer nip portion while held thereby. The recording medium S having passed through the secondary transfer nip portion is separated from the surface of the intermediate transfer member 34 and introduced into a fixing device 23, where it is heated and pressurized at a fixing nip portion. As a result, the developer images of the different colors are mixed together and fixed to the recording medium S. Then, the recording medium S leaves the fixing device 23, and is discharged onto a discharge tray 100*c* by a discharge roller pair 24 as a medium with a full color image. After the separation of the recording medium S from the intermediate transfer member 34, the secondary transfer residual toner remaining on the surface of the intermediate transfer member 34 is removed. In the case of the present exemplary embodiment, the residual toner electrostatically adheres to the surface of the drums 32*a* at the primary transfer nip portions between the drums 32*a* and the intermediate transfer member 34, and is removed by the cleaning blades 32*c*.

As described above, the intermediate transfer member 34 is a rotary member of a drum-like configuration. The developer images of the different colors formed on the drums 32*a* are transferred to the intermediate transfer member 34 so as to be superimposed one upon the other. Then, the intermediate transfer member 34 transfers the developer images transferred in a superimposed state collectively to the recording medium S. As a result, a color image is formed on the recording medium S.

When forming a monochrome image, a K-color developer image formed on the drum 32*a* located opposite the cartridge 33K is transferred to the intermediate transfer member 34. Then, the intermediate transfer member 34 transfers the transferred K-color developer image to the recording medium S. In this way, a K-color image is formed on the recording medium S.

In the present exemplary embodiment, the secondary transfer roller 22 can be moved by a shift mechanism (not illustrated) to a first a position where it abuts the intermediate transfer member 34 to form the secondary transfer nip portion and to a second position where it is not in contact with, i.e., spaced away from, the intermediate transfer member 34. Then, when the image forming apparatus 100 performs image forming operation, the secondary transfer roller 22 is moved to the first position, and when the apparatus perform no image forming operation, it is moved to the second position. It is also possible for the secondary transfer roller 22 to be constantly held in contact with the intermediate transfer member 34.

The construction of the unit 200 will be described with reference to FIGS. 5A through 5C.

Figure 5B:
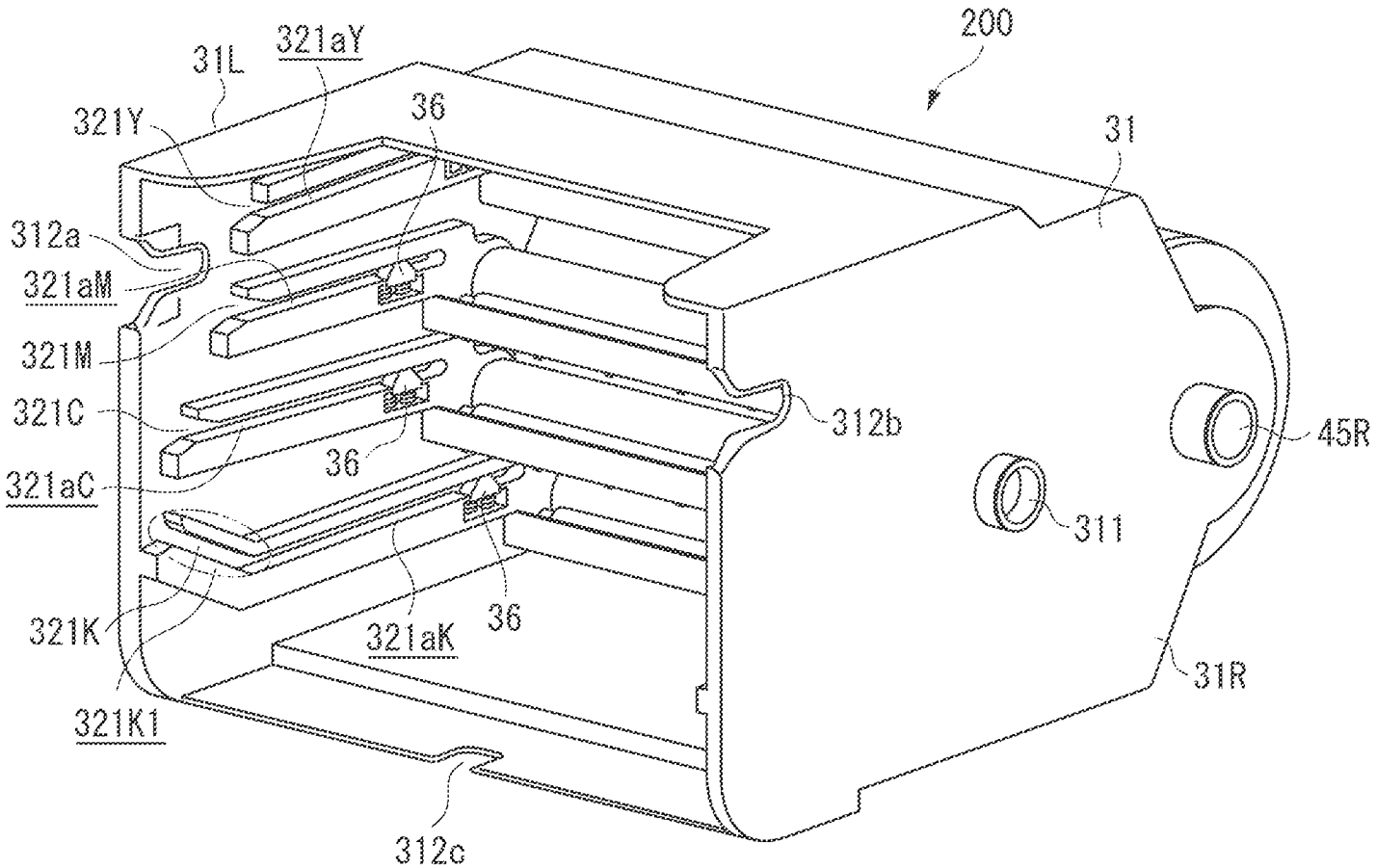
FIG. 5B is a right-hand side perspective view of the image forming unit according to the first exemplary embodiment.
Figure 5C:
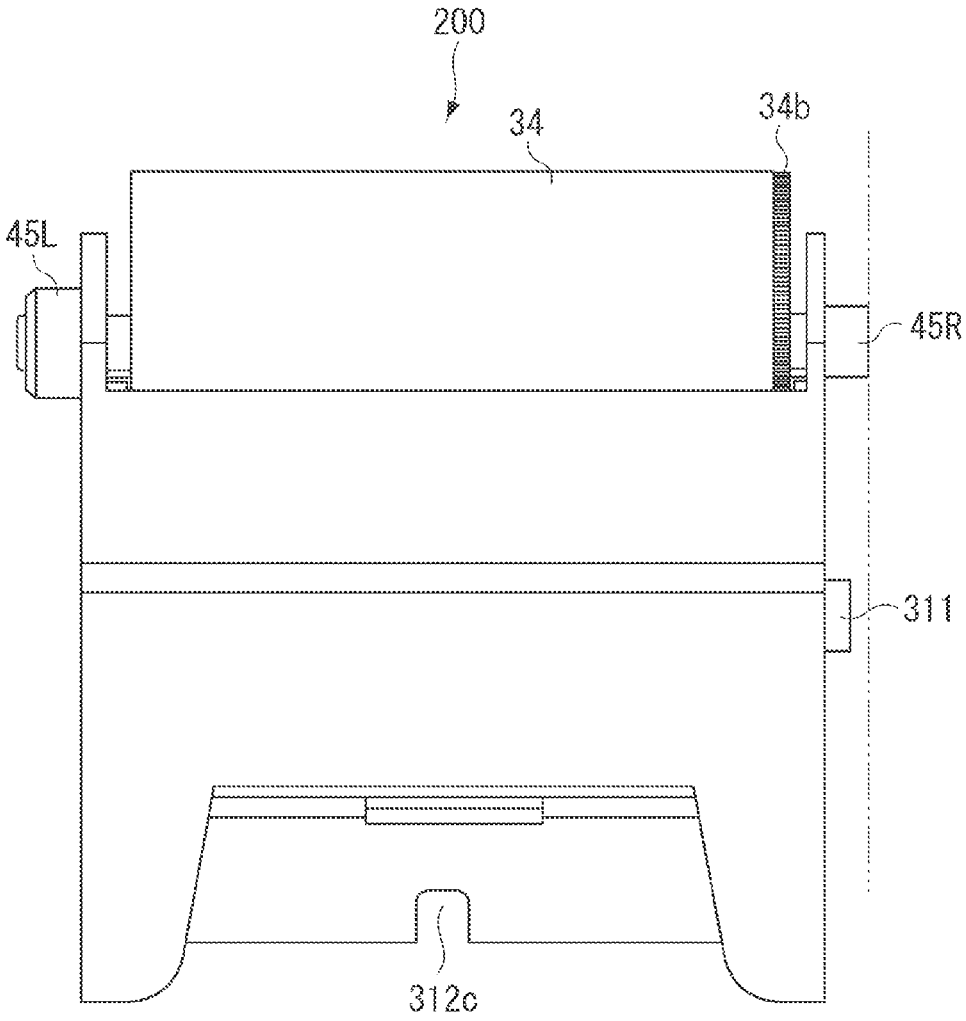
FIG. 5C is a top view of the image forming unit according to the first exemplary embodiment.

FIG. 5A is a perspective view of the unit 200 as seen from the left-hand side, FIG. 5B is a perspective view of the same as seen from the right-hand side, and FIG. 5C is a top view of the same. The unit 200 has a sub frame 31 that is detachable with respect to the main frame 110 of the apparatus main body 100A. The sub frame 31 rotatably supports the intermediate transfer member 34, which includes a cylindrical base body whose peripheral surface is coated with an elastic material. The intermediate transfer member 34 is supported with the left end portion and the right end portion of a central shaft (rotation center) 34*a* rotatably borne between a left-hand side plate 31L and a right-hand side plate 31R of the sub frame 31. At the right-hand end of the intermediate transfer member 34, there is provided a gear configured to transmit driving force to each drum 32*a*, transmitting a driving force transmitted from an apparatus main body drive source (not illustrated) to a drum gear 32*a*1. Around the intermediate transfer member 34, there are arranged the drums 32*a* while held in contact with the intermediate transfer member 34. Each of the drums 32*a* is set in position with respect to the sub frame 31 by virtue of a positioning construction (not illustrated), and is mounted so as to be rotatable around the axis of a drum. As a result, the drums 32*a* and the intermediate transfer member 34 allow mutual positioning with high accuracy. Further, the drums 32*a* are held in contact with the intermediate transfer member 34 with a predetermined pressing force.

On the outer sides of the left-hand side plate 31L and the right-hand side plate 31R, a left shaft portion 45L and a right shaft portion 45R are integrally fixed to the side plates 31L and 31R, respectively, so as to be coaxial with the central shaft 34*a* of the intermediate transfer member 34. Further, on the right-hand side plate 31R of the sub frame 31, there is provided a regulated portion 311 configured to regulate the inclination of the unit 200 inside the apparatus main body 100A. As illustrated in FIG. 5B, as compared with the right shaft portion 45R, the regulated portion 311 protrudes less from the sub frame side surface.

As described in detail below, the position and inclination of the unit 200 inside the apparatus main body 100A are determined by the left shaft portion 45L, the right shaft portion 45R, and the regulated portion 311. The left shaft portion 45L, the right shaft portion 45R, and the inclination regulated portion 311, which are the positioning portions for the intermediate transfer member 34 inside the apparatus main body 34, are provided on the same member, i.e., the sub frame 31, whereby the position of the intermediate transfer member 34 inside the apparatus main body 100A is determined with high precision. Further, as described above, the sub frame 31 is provided with cartridge attachment portions 321 for detachably attaching the cartridges 33. The function of the attachment portions will be described below.

Figure 6A:
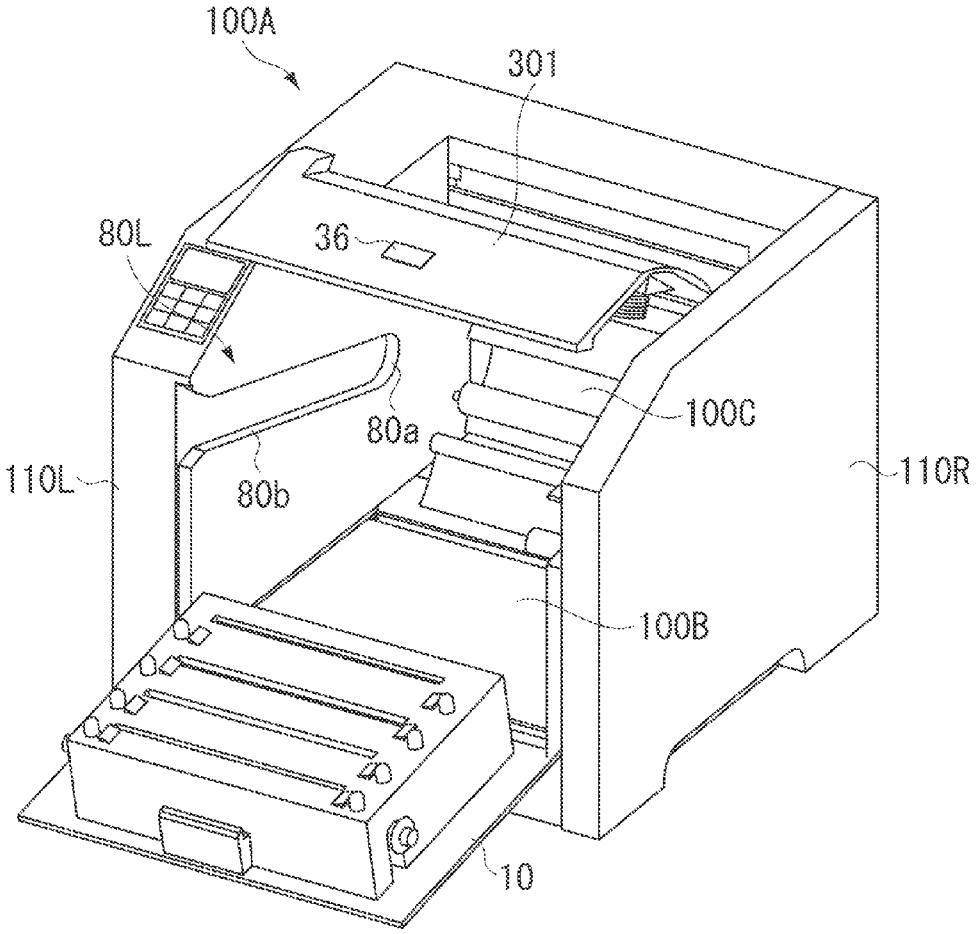
FIG. 6A is a left-hand side perspective view of an apparatus main body with the cover unit according to the first exemplary embodiment in the open state.
Figure 6B:
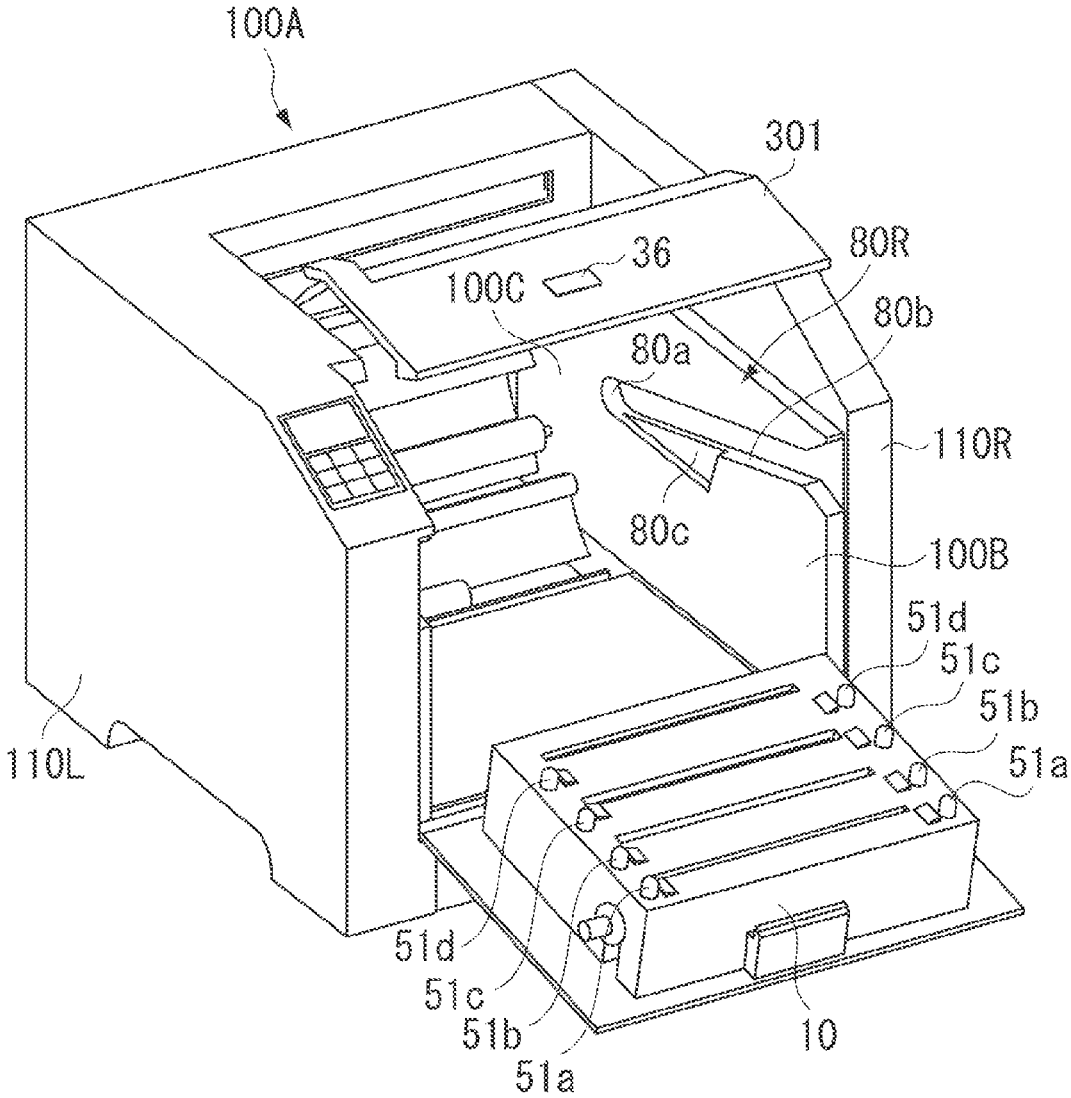
FIG. 6B is a right-hand side perspective view of the apparatus main body with the cover unit according the first exemplary embodiment in the open state.

As illustrated in FIGS. 6A and 6B, between the inner side of the left-hand side frame 110L and the inner side of the right-hand side frame 110R of the apparatus main body 100A, there are provided a left-hand side guide 80L and a right-hand side guide 80R so as to be located opposite each other. These guides 80L and 80R are respectively equipped with a positioning portion 80*a* rotatably supporting the left and right shaft portions 45L and 45R of the sub frame 31 and a guide portion 80*b* configured to guide the shaft portions 45L and 45R to the positioning portion 80*a*. Further, the right-hand side guide 80R is provided with an inclination regulating portion 80*c* dropped substantially to the level of the horizontal surface on the inner side in the longitudinal direction; it is held in contact with the inclination regulated portion 311 provided in the unit 200 described above to regulate the rotation of the unit 200.

As illustrated in FIGS. 6A and 6B, the upper portion of the apparatus main body 100A is provided as an upper cover unit 301, which can be opened and closed with respect to the apparatus main body 100A.

Next, the attachment of the unit 200 to the apparatus main body 100A will be described with reference to FIGS. 7A through 7E and FIG. 8A. FIGS. 7A through 7E are right-hand side longitudinal sectional views taken at the position of the right-hand side guide 80R, and FIGS. 8A and 8B are enlarged view of portion W indicated by a chain double-dashed line in FIG. 1B.

The lower end side of the cover unit 10 is rotatably connected to the apparatus main body 100A via a hinge shaft 10*a;* the cover unit 10 can assume a closed position (FIG. 1B) where the opening 100B in the side surface of the apparatus main body 100A is closed and an open position (FIG. 7A) where the opening 100B is open. More specifically, the cover unit 10 is an opening/closing member which is supported so as to be rotatable around the hinge shaft 10*a* at the front end of the apparatus main body 100A and which can open and close the opening 100B. The closed position of the cover unit 10 is maintained through engagement (latch engagement) between a lock claw portion 136*a* provided on the side of a maintenance button 136 arranged on the front surface of the apparatus main body 100A and a lock claw portion 10*b* provided on the cover 10 side as illustrated in FIGS. 8A and 8B. The lock claw portion 136*a* constitutes the main body side lock portion, and the lock claw portion 10*b* constitutes the opening/closing member side lock portion. The closing of the cover 10 is released by pressing the button 136. When the button 136 is pushed backwardly against the force of a return spring (not illustrated), the lock claw portion 136*a* on the button 136 side escapes backwards from the lock claw portion 10*b* of the cover 10 as indicated by the chain double-dashed line, whereby the latch engagement is released. As a result, it is possible to rotate the cover 10 around the hinge shaft 10*a* to the open position, placing the opening 100B in the wide-open state. In the present exemplary embodiment, the lock claw portion 136*a* and the lock claw portion 10*b* are locked to each other elastically and releasably. However, the present exemplary embodiment is not restricted to this construction. For example, it is also possible to adopt a construction in which a claw (lock portion) provided in one member is elastically and releasably locked to a hole (lock portion) provided in the other member.

Figure 9A:
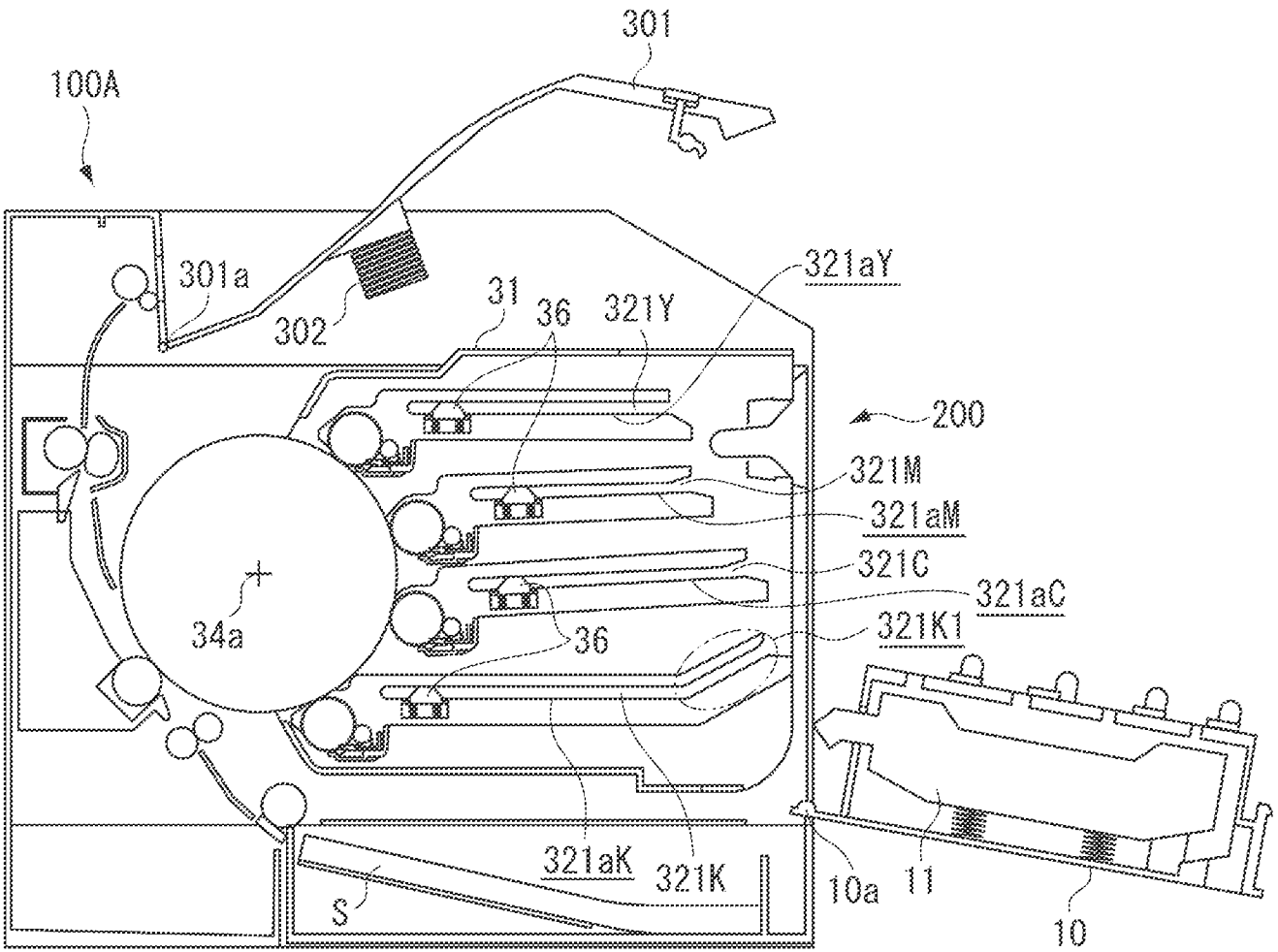
FIGS. 9A and 9B are diagrams illustrating the operation of an upper cover unit according the first exemplary embodiment.
Figure 9B:
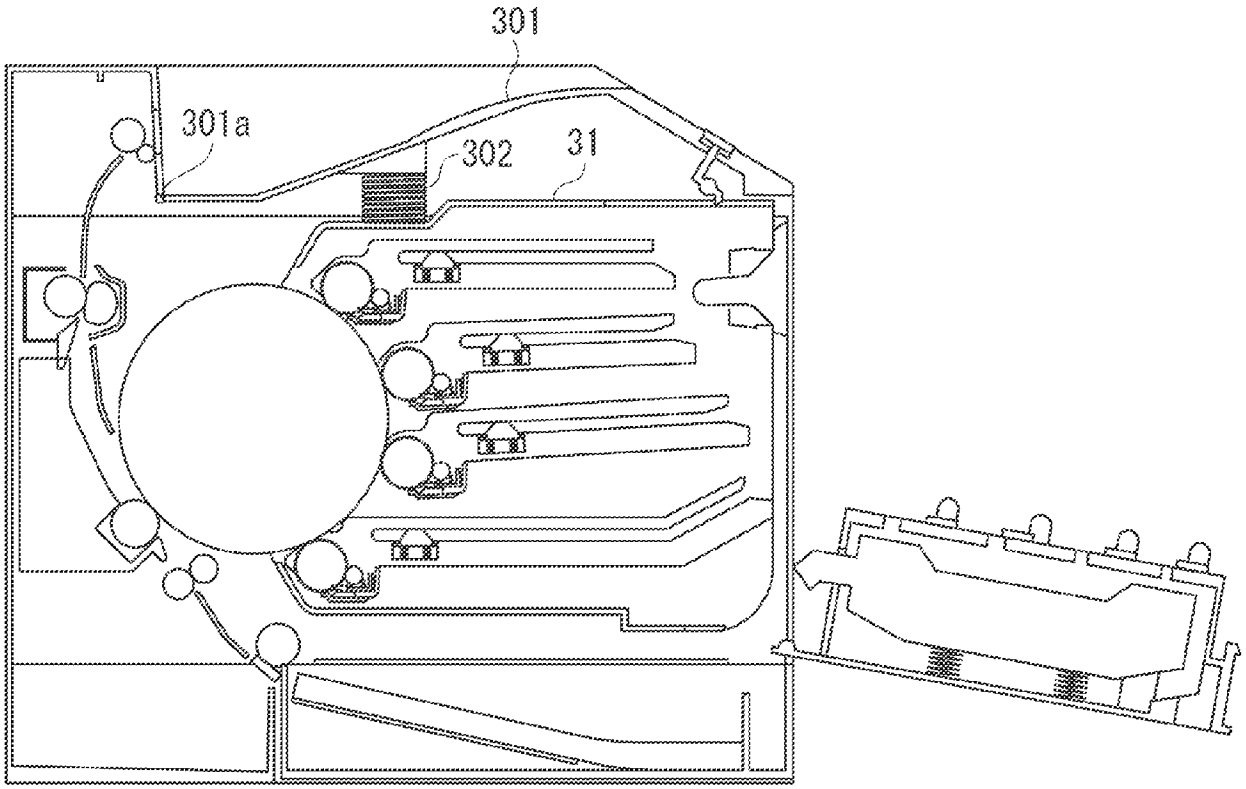

As illustrated in FIGS. 9A and 9B, the upper portion of the apparatus main body 100A is rotatably connected to the apparatus main body 100A via the hinge shaft 301*a* as the upper cover unit 301. The upper cover unit 301 can assume a closed position (FIG. 9B) where an opening 100C in the upper surface of the apparatus main body 100A is closed, and an open position (FIG. 9A) where the opening 100C is open. The closed position of this upper cover unit 301 is also maintained by a lock mechanism (not illustrated) similar to that for the cover unit 10.

The attachment of the unit 200 to the apparatus main body 100A will be described with reference to FIGS. 7A through 7F and FIGS. 9A and 9B.

Figure 7A:
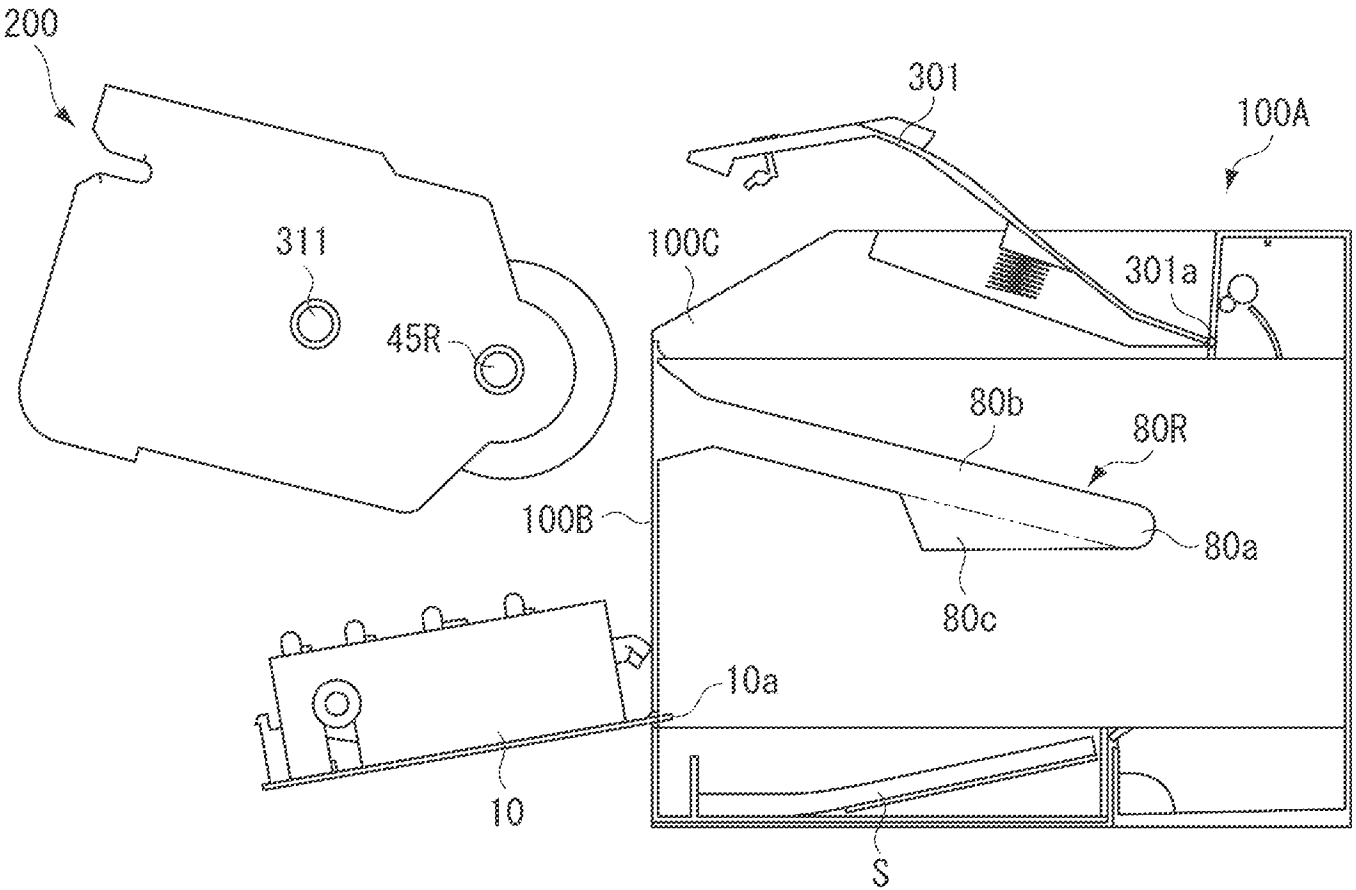
FIG. 7A is a diagram illustrating the attachment/detachment of the image forming unit according to the first exemplary embodiment.
Figure 8A:
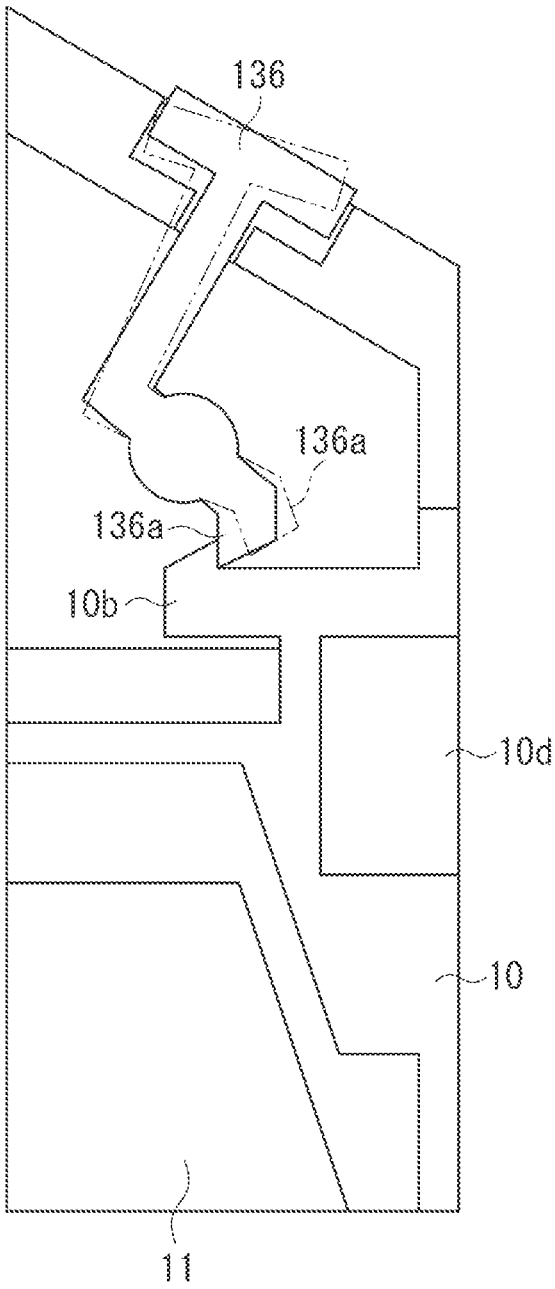
FIGS. 8A and 8B are explanatory views of a maintenance button according to the first exemplary embodiment.
Figure 8B:
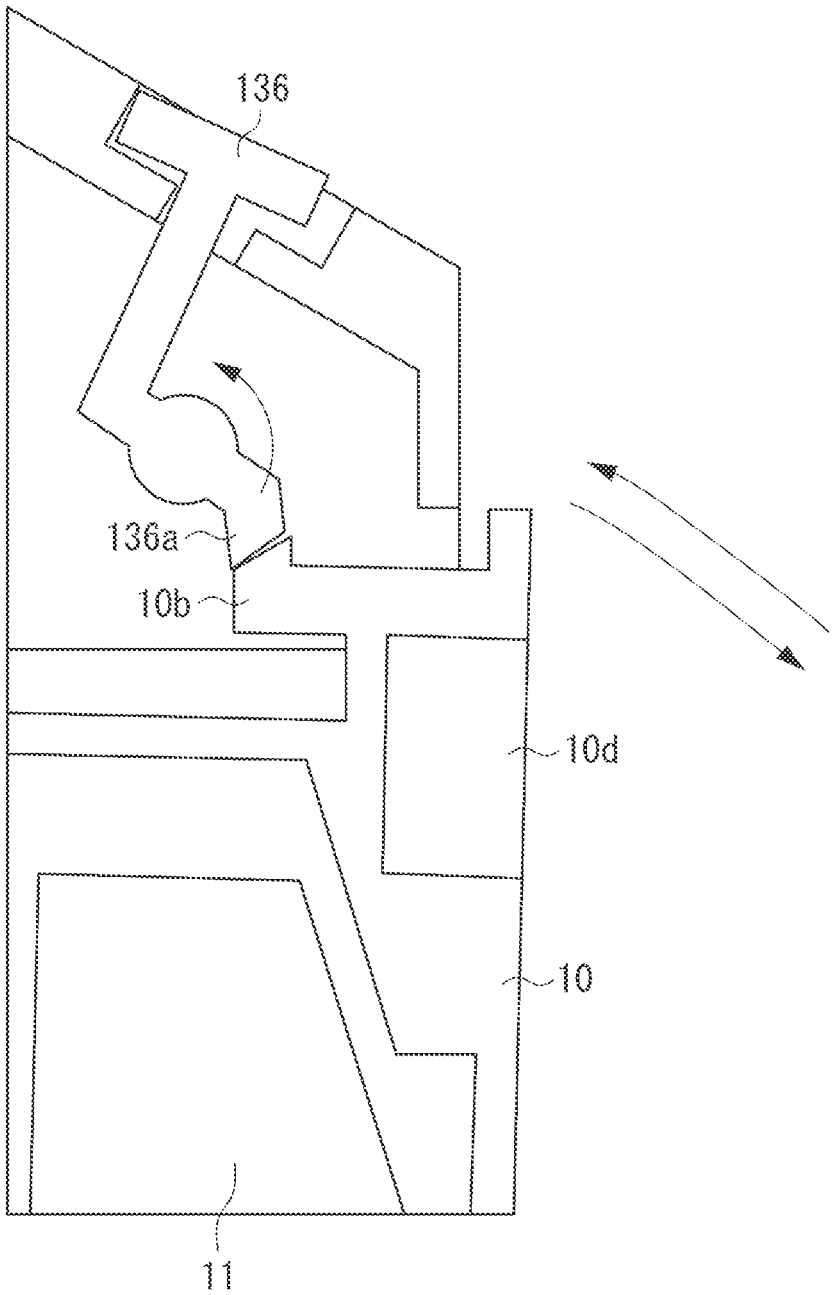

First, as illustrated in FIG. 7A, the upper cover unit 301 and the cover unit 10 of the apparatus main body 100A are placed in their open positions.

Next, the image forming unit is inserted into the apparatus main body 100A via the openings 100B and 100C.

Figure 7B:
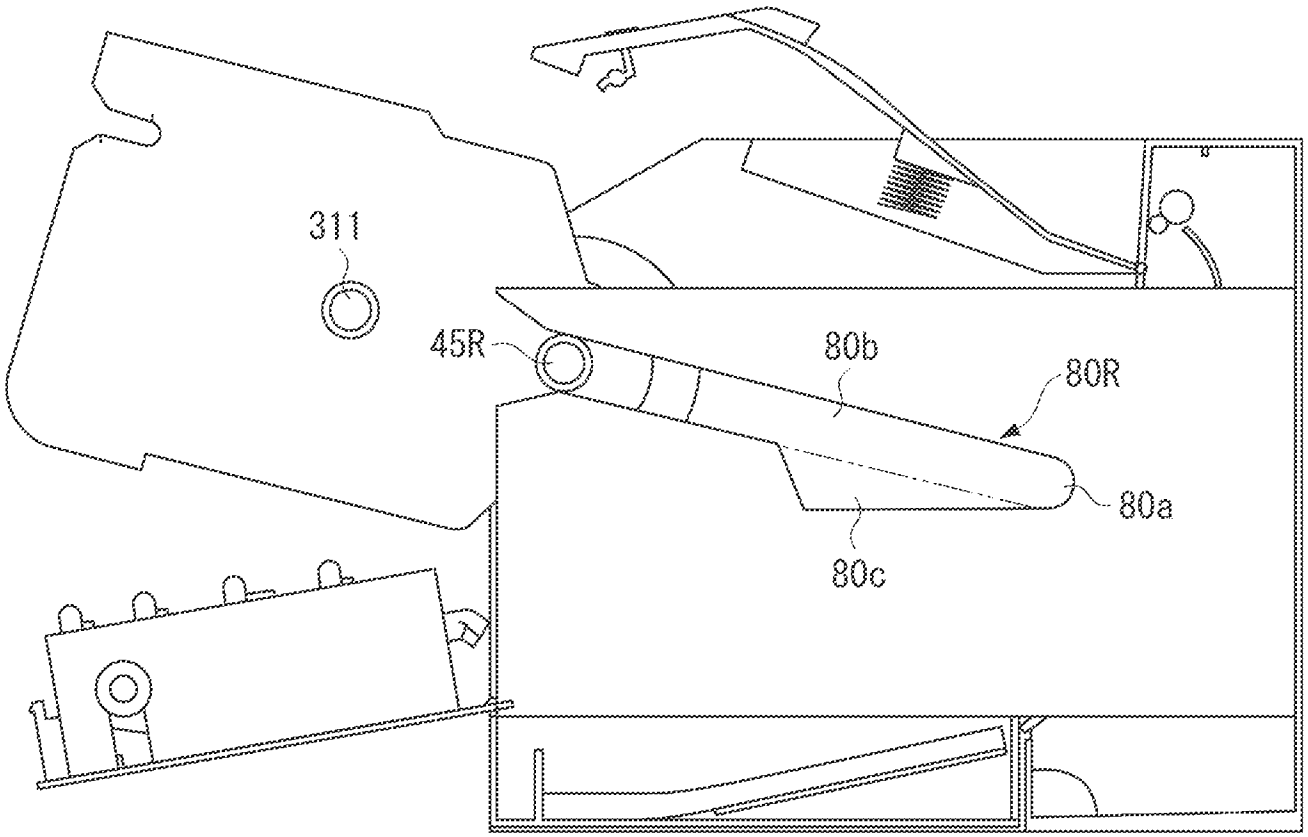
FIG. 7B is a diagram illustrating the attachment/detachment of the image forming unit according to the first exemplary embodiment.

First, the shaft portions 45L and 45R on the left and right sides of the sub frame respectively reach guide portions 80*b* provided opposite the left and right guides 80L and 80R on the apparatus main body 100A side (FIG. 7B). While FIGS. 7A through 7F only depict the shaft portion and the guide that are on the right-hand side, the same operation applies to both of the shaft portions and guides on the right-hand and left-hand sides except for the regulation of inclination.

Figure 7C:
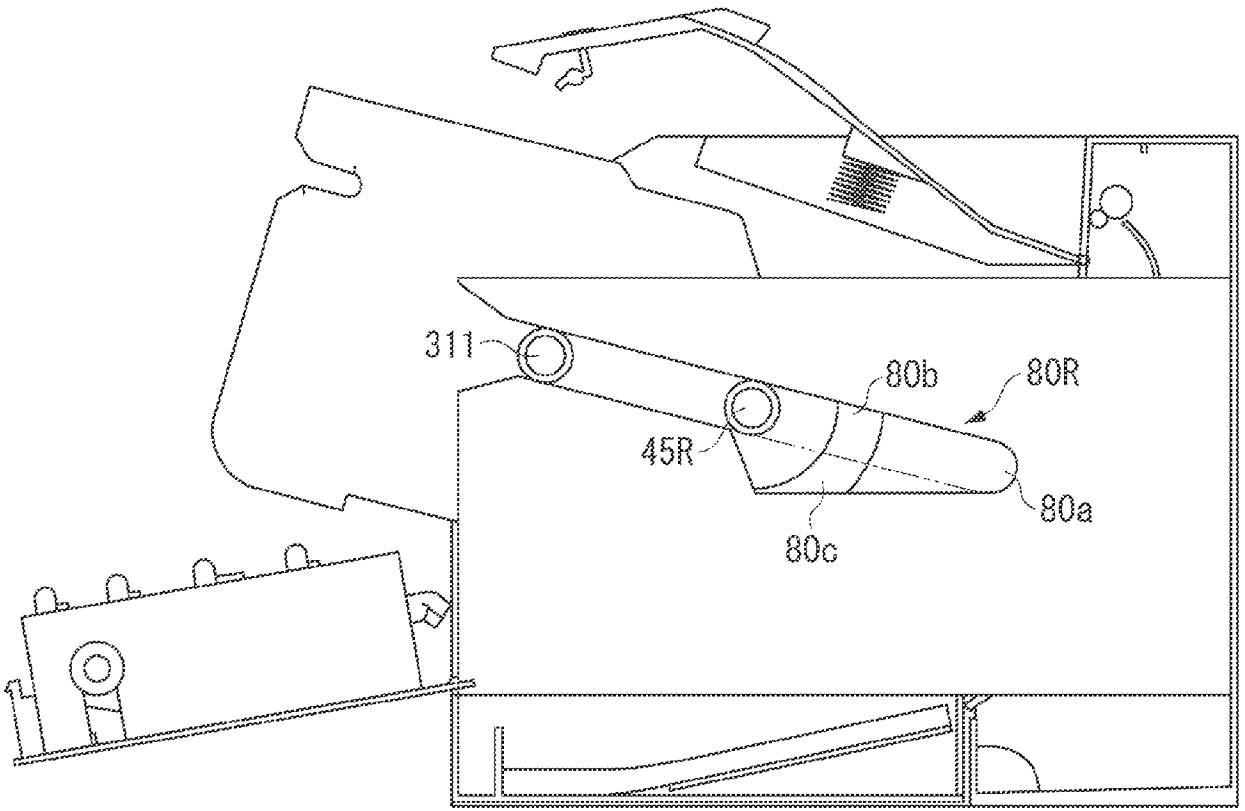
FIG. 7C is a diagram illustrating the attachment/detachment of the image forming unit according to the first exemplary embodiment.

As the attachment proceeds, the right-hand side shaft portion 45R is tilted inwardly in the longitudinal direction and reaches the portion where a regulating portion 80*c* is provided (FIG. 7C). It should be noted, however, that the right-hand side shaft portion 45R protrudes by a large amount from the sub frame side surface and reaches the guide portion 80*b* on the outer side in the longitudinal direction, so that the attachment proceeds along the guide portion 80*b*. Further, the inclination regulated portion 311 starts to be brought into contact with the guide portion 80*b*. At this time, the image forming unit 200 is in a positional relationship that allows it to be attached without interfering with the upper cover unit 301 and the cover unit 10.

Figure 7D:
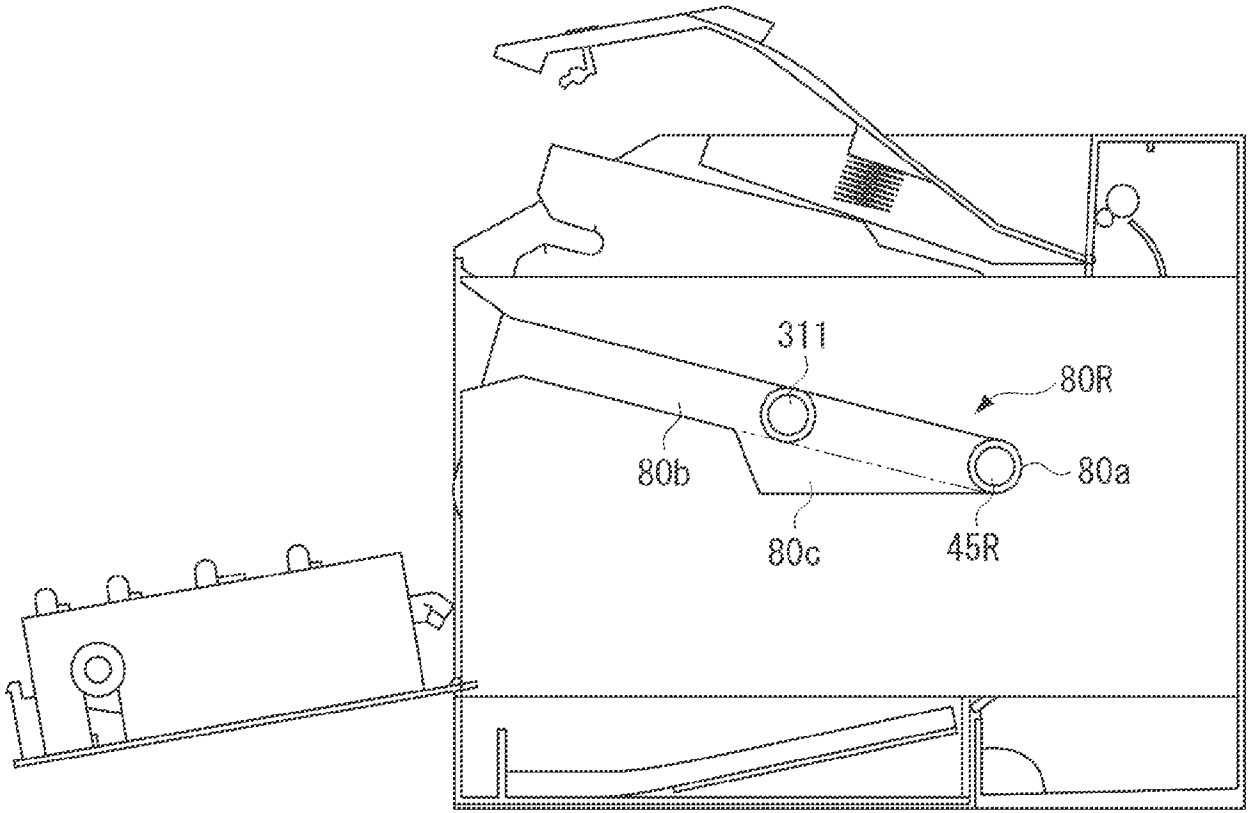
FIG. 7D is a diagram illustrating the attachment/detachment of the image forming unit according to the first exemplary embodiment.
Figure 7E:
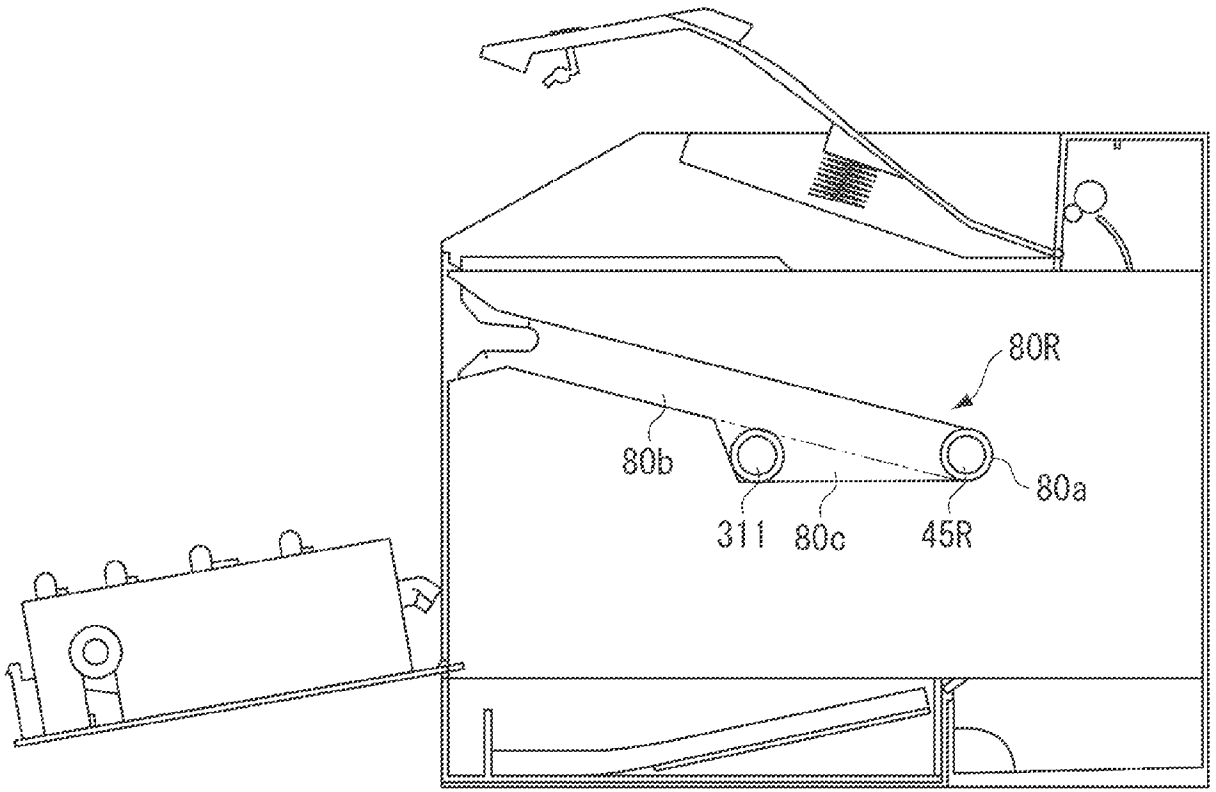
FIG. 7E is a diagram illustrating the attachment/detachment of the image forming unit according to the first exemplary embodiment.

As the attachment further proceeds, the left and right shaft portions 45L and 45R reach positioning portions 80*a* provided in the extensions of the guide portions 80*b* (FIG. 7D). On the other hand, the inclination regulated portion 311 comes to the position of the rotation regulating portion 80*c* of the guide. The inclination regulated portion 311 protrudes from the sub frame side surface by a relative small amount, and is not brought into contact with the guide portion 80*b* on the outer side in the longitudinal direction. Thus, the image forming unit is rotated to the position illustrated in FIG. 7E around the shaft portions 45L and 45R.

At this time, the gear 34*b* (FIG. 5C) provided at one end of the intermediate transfer member 34 is connected with a driving gear (not illustrated) provided inside the apparatus main body 100A. Then, finally, the upper cover unit is closed, whereby the attachment is completed (FIGS. 9A and 9B). When the upper cover unit 301 is closed, a compression spring 35, which is an urging member, urges and suppresses the upper portion of the sub frame 31, so that the image forming unit is held in a stable manner at the position illustrated in FIG. 9B.

When detaching the unit 200, the procedures involved are reverse to those for the attachment described above. More specifically, the upper cover unit 301 is moved to the open position, and the unit 200 is rotated around the shaft portions 45L and 45R until the inclination regulated portion 311 comes to a position where it is brought into contact with the ceiling surface of the guide portion 80*b* before being pulled out along the guide portion 80*b*.

After the attachment of the unit 200 through the above procedures, the four cartridges 33 (33Y, 33M, 33C, and 33K) are attached to the attachment portions 321 (321Y, 321M, 321C, and 321K) provided on the sub frame 31.

Next, the attachment/detachment of the cartridges 33 (33Y, 33M, 33C, and 33K) with respect to the unit 200 attached to the apparatus main body 100A will be described.

Here, the attachment of the fourth cartridge 33K, which is attached to the lowermost stage, will be first described.

In the present exemplary embodiment, the cover unit 10 is opened downwardly, so that the fourth cartridge 33K is the cartridge that is attached to the position nearest to the cover unit 10 at the open position.

First, the portions related to the attachment of the cartridge 33K, the attachment guides 321K thereof, and the attachment procedures will be described with reference to FIGS. 3A through 3C, FIGS. 5A through 5C, and FIGS. 9A and 9B.

Figure 3C:
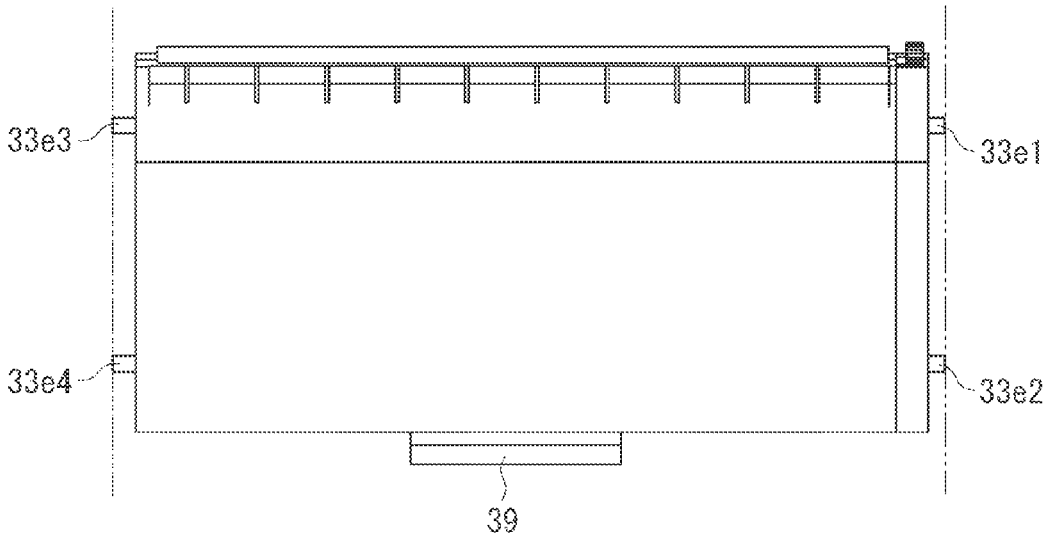
FIG. 3C is a top view of the first cartridge according to the first exemplary embodiment.

As in the case of the cartridge 33Y illustrated in FIGS. 3A and 3B, there are provided guided portions 33*e*1 through 33*e*4 on both side surfaces in the longitudinal direction of the cartridge 33K. As illustrated in FIG. 3C, the guided portions 33*e*2 and 33*e*4 farther from the developing roller 33*b* and the guided portions 33*e*1 and 33*e*3 nearer thereto protrude from the cartridge side surfaces by the same amount.

On the other hand, as illustrated in FIGS. 5A and 5B, the sub frame 31 of the image forming unit 200 is provided with attachment guides 321 (321Y, 321M, 321C, and 321K) for attaching and positioning the four developing cartridges. Here, as illustrated in FIGS. 9A and 9B, the configuration of the attachment guides 321K of the cartridge attached to the lowermost stage is such that they first descend from the inlet and then extend substantially horizontally toward the depth, whereas the configuration of the other guides 321Y, 321M, and 321C are substantially horizontal over the entire range. More specifically, the guide surfaces 321*a*K of the attachment guides 321K have portions which first extend away from the guide surfaces 321*a*Y, 321*a*M, and 321*a*C of the attachment guides of the other cartridges in the direction in which the cartridges are adjacent to each other (in the vertical direction in FIGS. 9A and 9*b* in the present exemplary embodiment). Then, they extend substantially horizontally to be guided to the attachment positions. The guide surfaces are surfaces guiding the cartridge when attaching the cartridge. Further, in front of the positioning portions of the attachment guides 321K, there are provided regulating members 36. The regulating members 36 are chevron-shaped members; in the free state, they are pushed up by the urging force of urging members 37, and their chevron-shaped portions enter the attachment portions 321K, with the upper surfaces thereof abutting the ceiling surfaces of the attachment portions 321K to be thereby received.

Figure 10A:
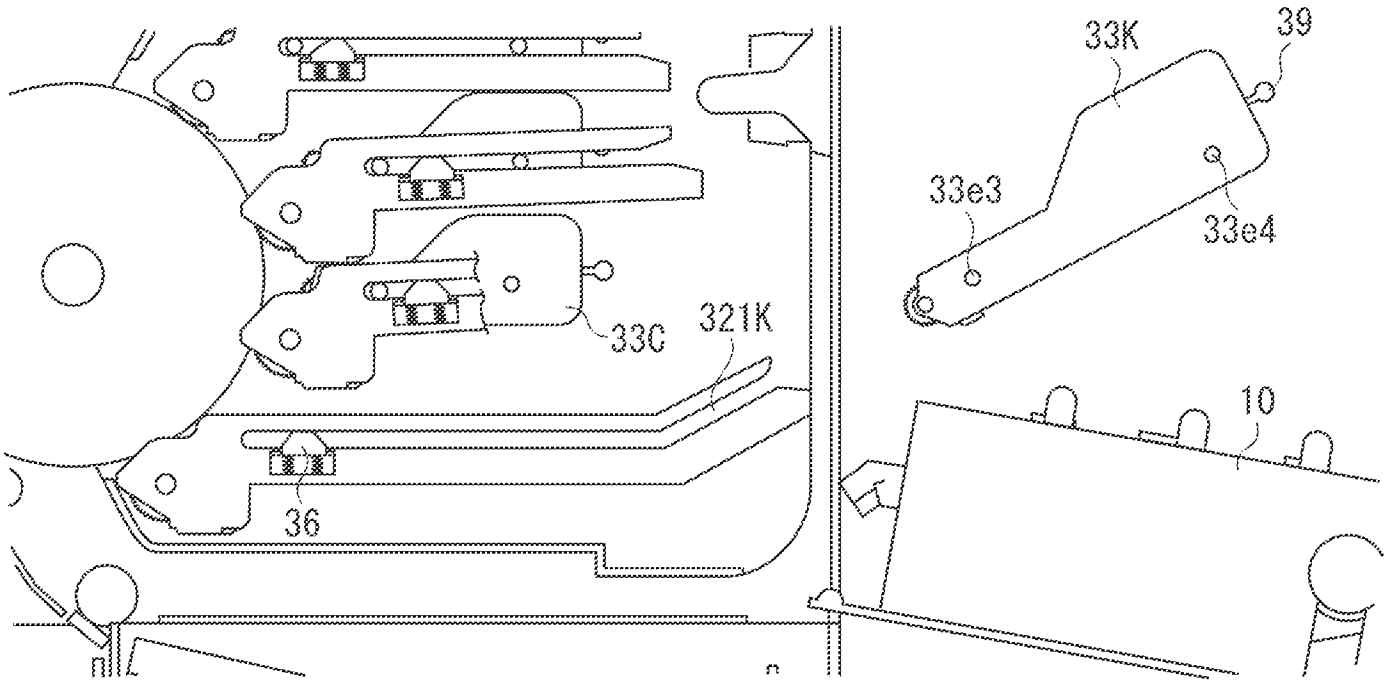
FIG. 10A is an explanatory view illustrating the attachment/detachment of the cartridge attached to the lowermost stage according to the first exemplary embodiment.
Figure 10B:
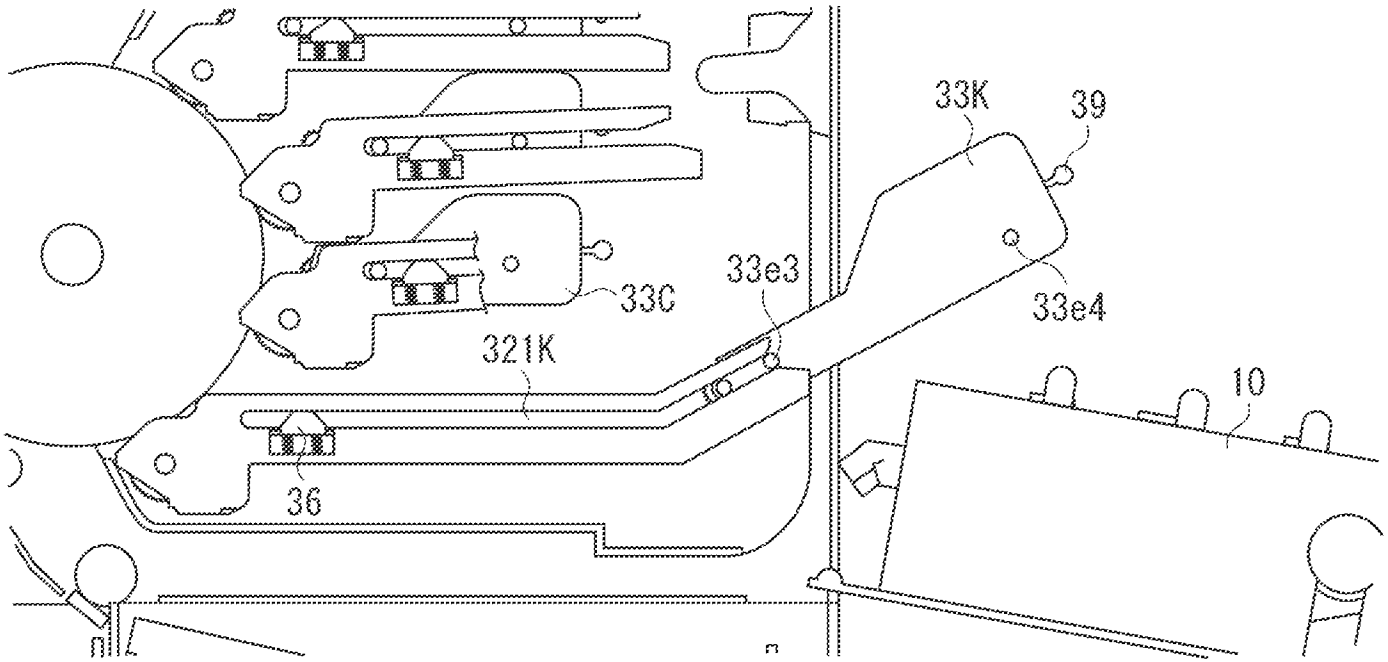
FIG. 10B is an explanatory view illustrating the attachment/detachment of the cartridge attached to the lowermost stage according to the first exemplary embodiment.
Figure 10C:
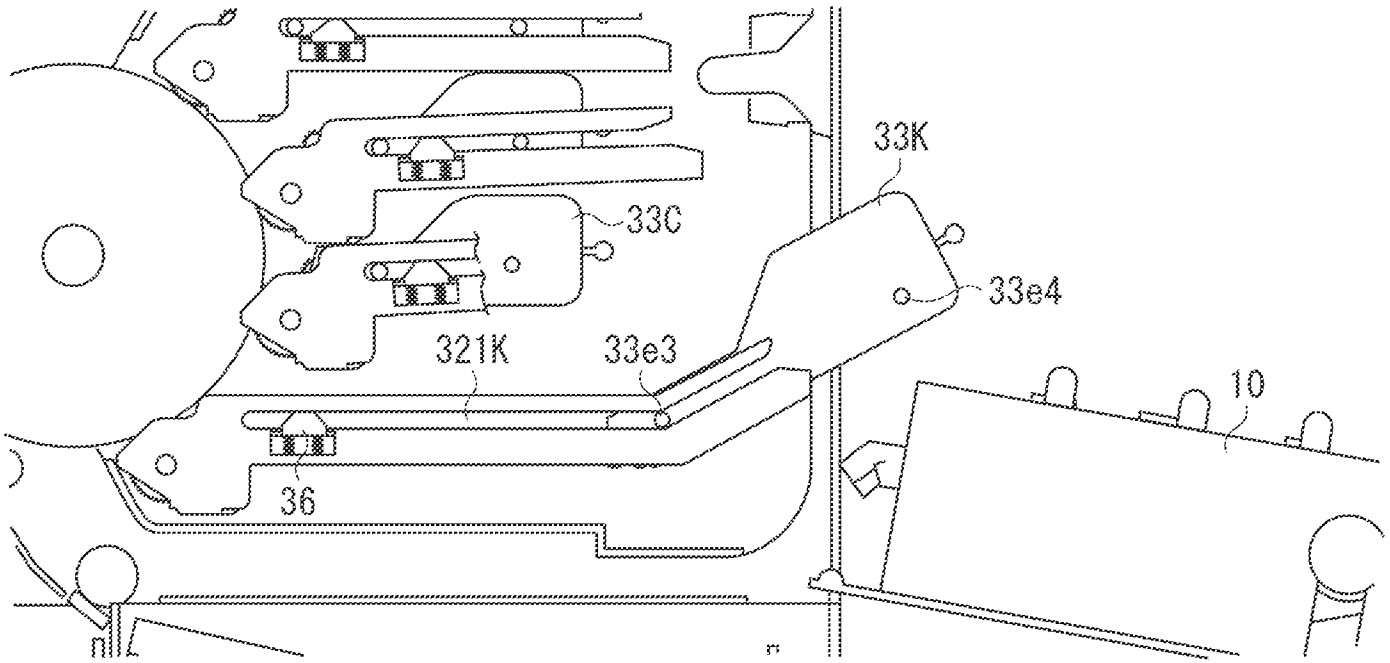
FIG. 10C is an explanatory view illustrating the attachment/detachment of the cartridge attached to the lowermost stage according to the first exemplary embodiment.

Next, the attachment procedures will be described with reference to FIGS. 10A through 10G. FIGS. 10A through 10C are left-hand side longitudinal sectional views of the image forming apparatus 100 when attaching the cartridge 33K.

First, the cover unit 10 is set at the open position where it opens the opening 100B (FIG. 10A).

Next, a grip portion 39 provided on the cartridge 33K is grasped, and the cartridge 33K is attached to the corresponding attachment portions 321K of the unit 200. The cartridge 33K is attached from a direction orthogonal to the rotation axis of the developing roller 32*b* (attachment direction). That is, the guided portions 33*e*1 and 33*e*3 on the cartridge 33K side are inserted into the unit 200 side attachment portions 321K. As illustrated in FIG. 10B, at this time, the cartridge is in a positional relationship which helps to avoid interference with the cover unit 10 and allows insertion without a hitch. While in FIGS. 10A through 10G, of the guided portions 33*e*1 through 33*e*4, only the guided portions 33*e*3 and 33*e*4, which are on the left-hand side, are depicted, the same description applies to those on the right-hand side.

Figure 10D:
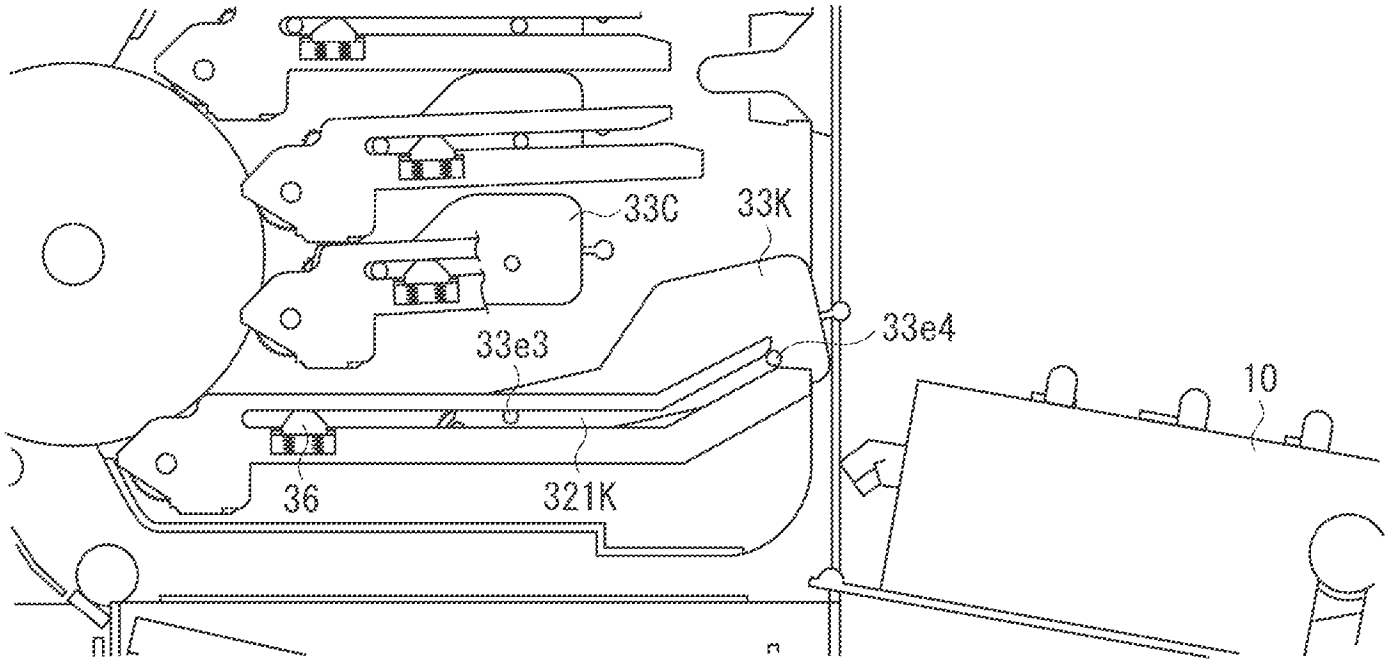
FIG. 10D is an explanatory view illustrating the attachment/detachment of the cartridge attached to the lowermost stage according to the first exemplary embodiment.

Next, as illustrated in FIG. 10C, the guided portions 33*e*1 and 33*e*3 on the side nearer to the developing roller 33*b* reach the substantially horizontal portions of the guides 321K. From these portions, the cartridge 33K is inserted substantially horizontally along the configuration of the guides 321K; at the same time, the inclination of the cartridge 33K is changed to put the guided portions 33*e*2 and 33*e*4 into the attachment portions 321K (FIG. 10D). At this point in time, all the guided portions 33*e*1 through 33*e*4 enter the attachment portions 321K, so that the inclination of the cartridge is stabilized.

Figure 10E:
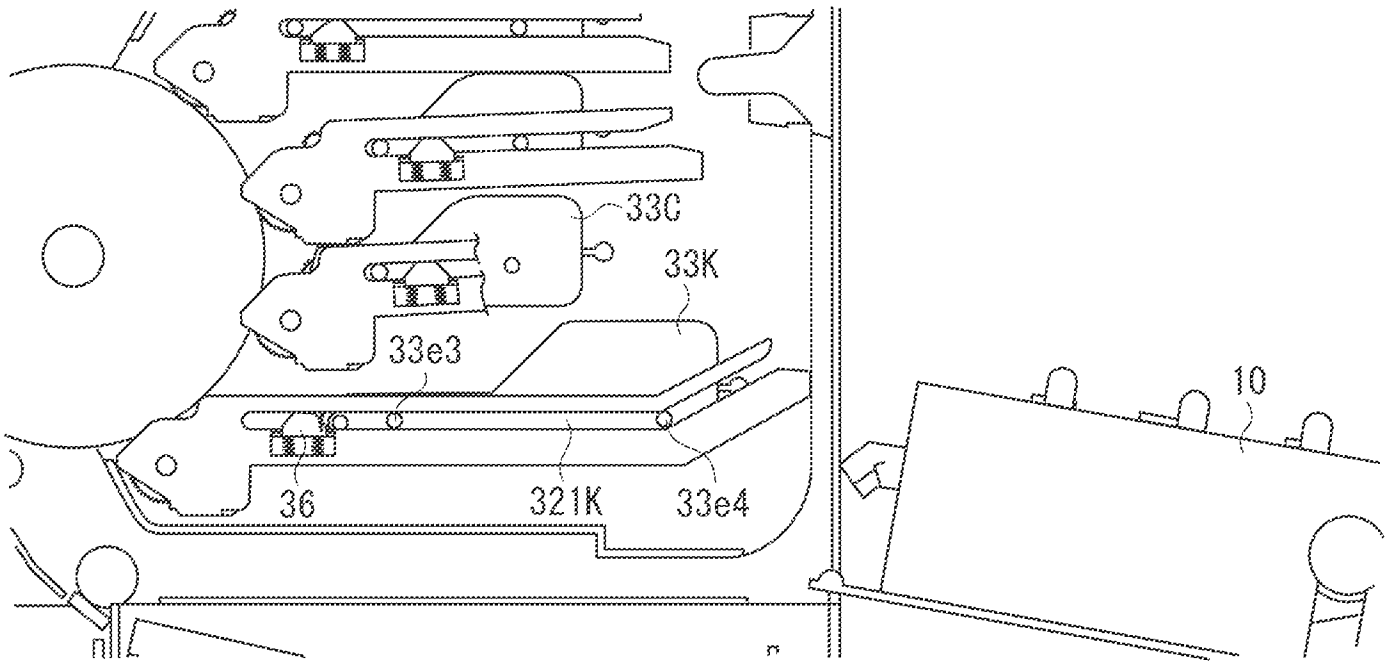
FIG. 10E is an explanatory view illustrating the attachment/detachment of the cartridge attached to the lowermost stage according to the first exemplary embodiment.

As the cartridge 33K is further inserted toward the depth, the guided portions 33*e*1 and 33*e*3 move substantially horizontally along the guides, and the rear side guide portions 33*e*2 and 33*e*4 continue to move downwards, so that the cartridge 33K is attached while changing its inclination. At this time, the cartridge 33K is attached while avoiding interference with the cartridge 33C directly above it. Then, the guided portions 33*e*2 and 33*e*4 reach the substantially horizontal portions of the guides 321K (FIG. 10E).

Figure 10F:
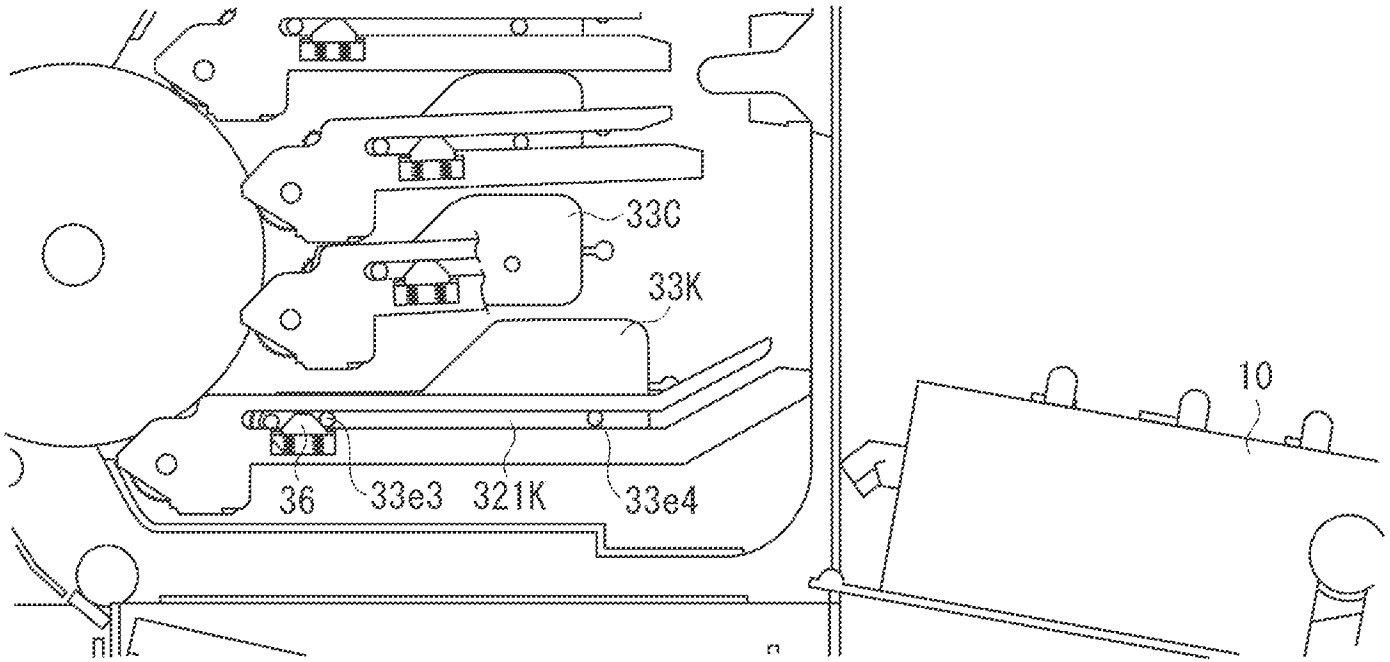
FIG. 10F is an explanatory view illustrating the attachment/detachment of the cartridge attached to the lowermost stage according to the first exemplary embodiment.

From here, when the cartridge 33K is attached substantially horizontally along the guides 321K, the guided portions 33*e*1 and 33*e*3 are attached while pushing down the regulating members 36 as illustrated in FIG. 10F.

Figure 10G:
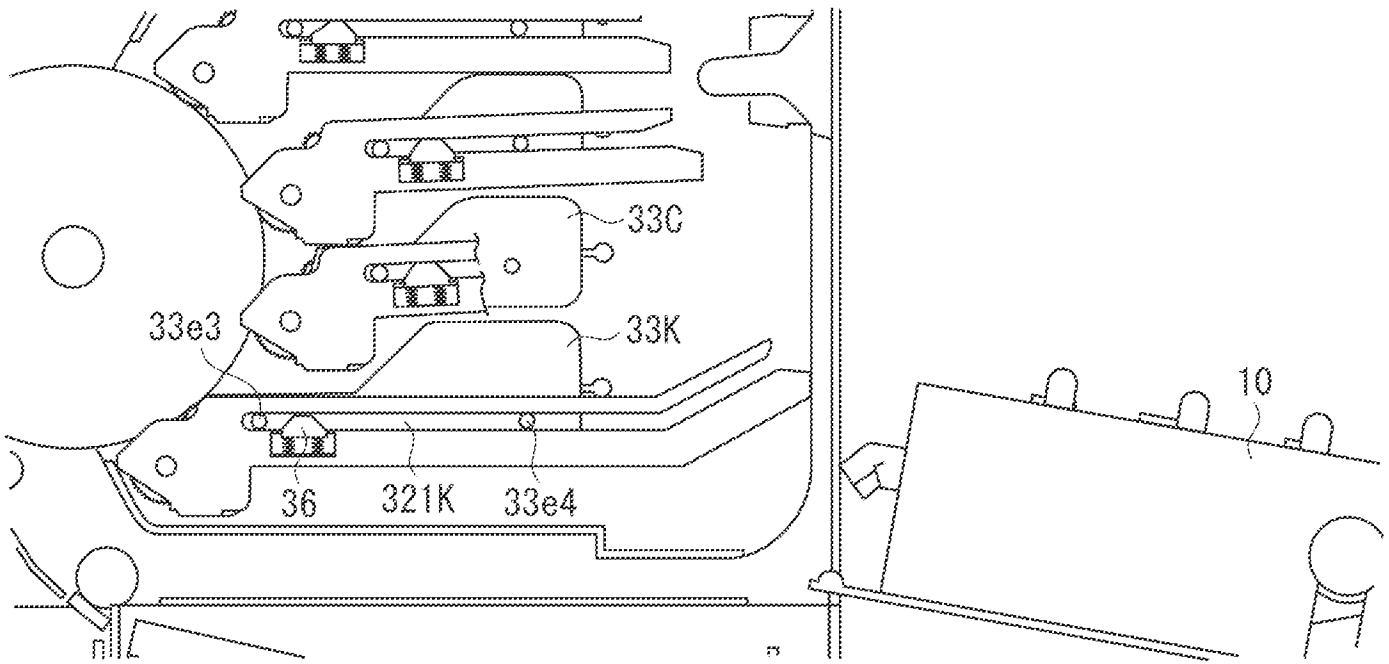
FIG. 10G is an explanatory view illustrating the attachment/detachment of the cartridge attached to the lowermost stage according to the first exemplary embodiment.

Finally, as illustrated in FIG. 10G, the guided portions 33*e*1 and 33*e*3 get over the regulating members 36, and reach the innermost portions of the attachment portions 321K, whereby the attachment is completed. At this time, the guided portions 33*e*1 through 33*e*4 are situated at the horizontal portions of the guides 321K. Thus, the inclination of the cartridge 33K completely attached is substantially horizontal.

In the present exemplary embodiment, the configuration of the cartridge attachment guides 321K attached to the lowermost stage is such that they first descend from the inlet and then extend substantially horizontally toward the final positioning portions; that is, they first leave the other cartridge attachment positions, and then extend substantially horizontally.

Next, the attachment/detachment of the three upper cartridges 33Y, 33M, and 33C will be described.

First, the guided portions 33*e*1 through 33*e*4 of the cartridges and the attachment guides 321 will be described with reference to FIGS. 3A through 3C, FIGS. 5A through 5C, and FIGS. 9A and 9B.

As illustrated in FIGS. 3A and 3B, as in the case of the cartridge 33K, the guided portions 33*e*1 through 33*e*1 are provided on the side surfaces in the longitudinal direction of the cartridges 33Y, 33M, and 33C. As illustrated in FIG. 3C, the guided portions 33*e*1 through 33*e*4 protrude from the cartridge side surfaces by the same amount.

On the other hand, as illustrated in FIGS. 4, 5A, and 5B, the sub frame of the image forming unit is provided with the attachment guides 321 (321Y, 321M, 321C, and 321K) for attaching and positioning the four developing cartridges. Here, as illustrated in FIGS. 9A and 9B, the configuration of the upper three attachment guides 321Y, 321M, and 321C is substantially horizontal.

Further, in front of the inner most portions of the attachment guides 321Y, 321M, and 321C, there are provided regulating members 36 as in the case of the attachment guides 321K.

Regarding the manner of attachment, it is the same as that for the lowermost cartridge 33K except for the attachment paths of the attachment guides (the configuration of the guide surfaces of the attachment guides). The guided portions 33*e*1 through 33*e*4 are respectively inserted into the attachment guides 321Y, 321M, and 321C, and are inserted up to the positions beyond the regulating members 36, whereby the attachment is completed.

when the attachment of the four cartridges 33Y, 33M, 33C, and 33K has been completed as described above, the state as illustrated in FIG. 4 is attained.

Further, as stated above, with the unit 200 being situated at the image forming position, the apparatus main body 100A has cartridge urging members 51*a* through 51*d* urging the cartridges 33 toward the corresponding photosensitive drums 32*a* (FIGS. 4 and 6B). The urging members 51*a* through 51*d* are provided at both ends in the longitudinal direction (horizontal direction) of the cartridges 33, each cartridge being equipped with two urging members. The urging members 51*a* through 51*d* are provided on the cover unit 10, and successively bring the cover unit 10 into contact with the rear end portions of the cartridges 33 in conjunction with the operation of closing the cover unit 10. When, as in the case of FIG. 1B, the cover unit 10 is situated at the closed position, the cartridges 33 are urged in the direction of the arrow Y2 by the urging members 51*a* through 51*d*.

As described above, at this time, the guided portions 33*e*1 through 33*e*4 of the cartridge 33K are situated at the horizontal portions of the attachment guides 321K (FIG. 10G), so that there is no fear of their inclination being changed to become unstable due to the position of the cartridge.

Further, all of the attachment guides 321Y, 321M, and 321C are of a substantially horizontal configuration, so that, as in the case of the cartridge 33K, there is no fear of the inclination of the cartridges 33Y, 33M, and 33C being changed to become unstable due to the positions of the cartridges.

Then, the developing rollers 33*b* accommodated in the cartridges 33 are brought into contact with the drums 32*a* with a fixed urging force by bringing regulation runners (not illustrated) provided at both ends thereof into contact with the drums 32*a*. The urging force due to the urging members 51*a* through 51*d* maintains a satisfactory contact state (or separation state) between the developing rollers 33*b* and the drums 32*a*.

As described above, in the construction of the present exemplary embodiment, the laser scanner unit 11, which is an exposure unit for performing image exposure, is mounted on the cover unit 10, which is a cover member for opening and closing the opening 100B allowing the attachment/detachment of the cartridges. The cover unit 10 is configured to be opened downwardly. In this construction, the attachment guides 321K of the cartridge 33K attached to the lowermost stage have, in the vicinity of the portion near the inlet, portions extending from the upstream to the downstream side with respect to the cartridge attachment direction so as to descend with respect to the horizontal direction.

More specifically, the attachment guide units 321K of the cartridge 33K attached to the attachment position nearest to the cover unit in the open position have portions extending from the upstream to the downstream side with respect to the cartridge attachment direction away from the attachment paths of the guide units of the other cartridges.

Thus, the cartridge door is so much the thicker for the mounting of the scanner; even if the lower side portion of the cartridge opening is partially stopped in order to achieve a reduction in apparatus size, it is also possible to smoothly attach and detach the cartridge to and from attachment portion nearest to the stopped portion.

Thus, a reduction in apparatus size and smooth attachment/detachment of the cartridges are compatible with each other.

Next, a second exemplary embodiment of the present invention will be described.

Regarding the present exemplary embodiment, the construction and operational features thereof different from those of the first exemplary embodiment will be described; the members of the same construction and function are indicated by the same reference numerals, and the illustration of the above exemplary embodiment is applicable for such members.

The present exemplary embodiment differs from the first exemplary embodiment in the configuration and construction of the attachment guides 321K which are the guide units for the fourth cartridge 33K. In this connection, the guide portions of the fourth cartridge 33K are different.

That is, in the second exemplary embodiment described below, the attachment path of the cartridge 33K is different due to the difference in the guide units.

Regarding the present exemplary embodiment, the attachment/detachment of the cartridge 33K with respect to the unit 200 attached to the apparatus main body 100A will be described.

In the present exemplary embodiment, the cover unit 10 is opened downwardly, so that the fourth cartridge 33K is the cartridge attached to the end portion nearest to the cover unit in the open position.

First, the portions related to the attachment of the cartridge 33K, the attachment guides 321K thereof, and the attachment procedures will be described with reference to FIGS. 11A through 11C, and FIGS. 12, 14A, 14B, and 15.

Figure 11A:
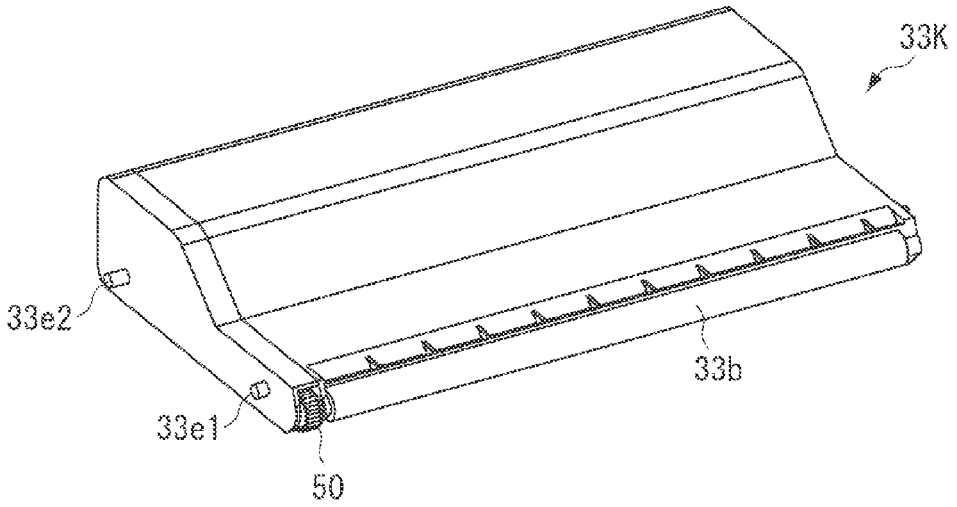
FIG. 11A is a right-hand rear side perspective view of a cartridge attached to the lowermost stage according to a second exemplary embodiment of the present invention.
Figure 11B:
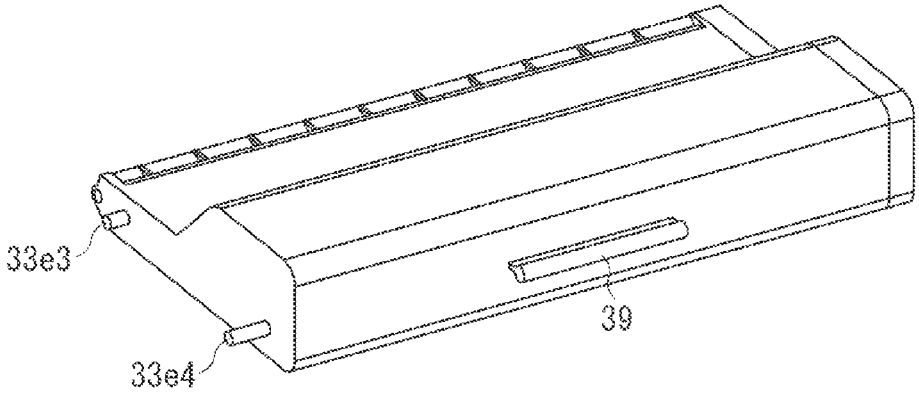
FIG. 11B is a left-hand front side perspective view of the cartridge attached to the lowermost stage according to the second exemplary embodiment.
Figure 11C:
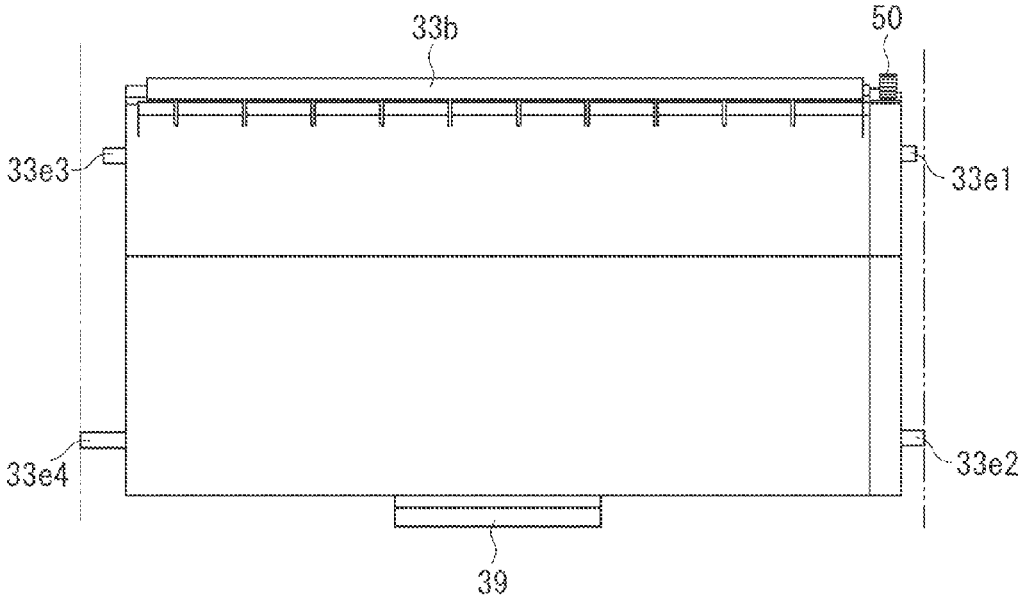
FIG. 11C is a top view of the cartridge attached to the lowermost stage according to the second exemplary embodiment.
Figure 12:
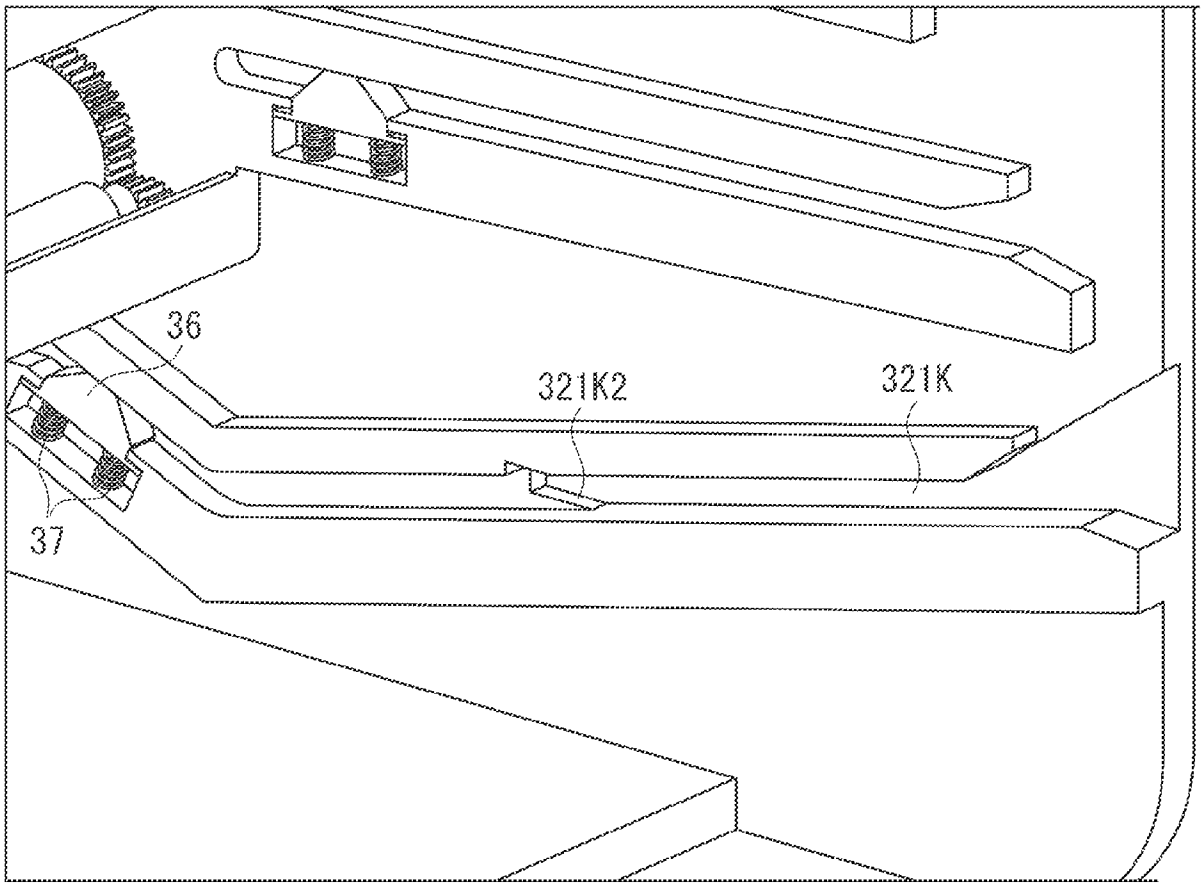
FIG. 12 is an explanatory perspective view of an attachment unit for the cartridge attached to the lowermost stage according to the second exemplary embodiment.
Figure 14A:
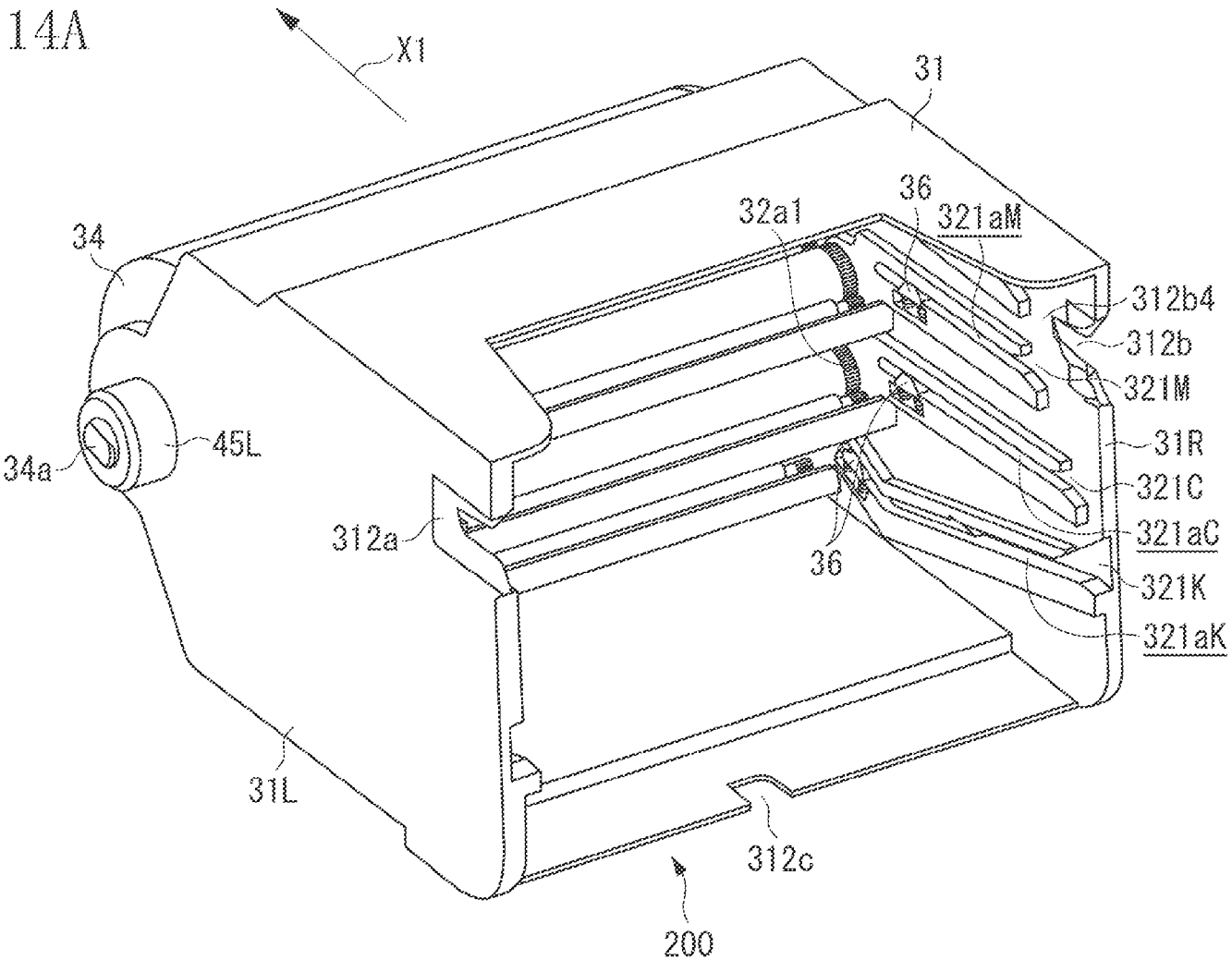
FIG. 14A is a left-hand side perspective view of an image forming unit according to the second exemplary embodiment.

Here, FIG. 11A is a perspective view of the cartridge 33K attached to the lowermost stage as seen from the right rear side, FIG. 11B is a perspective view of the cartridge 33K as seen from the left front side, and FIG. 11C is a plan view of the cartridge 33K. FIG. 12 is a perspective view of the right-hand side portions of the attachment guides 321K and 321K2 provided in the unit 200. FIG. 14A is a left-hand side perspective view of the image forming unit 200, FIG. 14B is a right-hand side perspective view thereof, and FIG. 15 is a left-hand side longitudinal sectional view of the image forming apparatus main body 100A.

As illustrated in FIGS. 11A and 11B, guided portions 33*e*1 through 33*e*4 are provided on both side surfaces in the longitudinal direction of the cartridge 33K. As illustrated in FIG. 11C, the guided portions 33*e*2 and 33*e*4 farther from the developing roller 33*b* protrude by a larger amount from the cartridge side surfaces than the guided portions 33*e*1 and 33*e*3 nearer thereto.

Figure 14B:
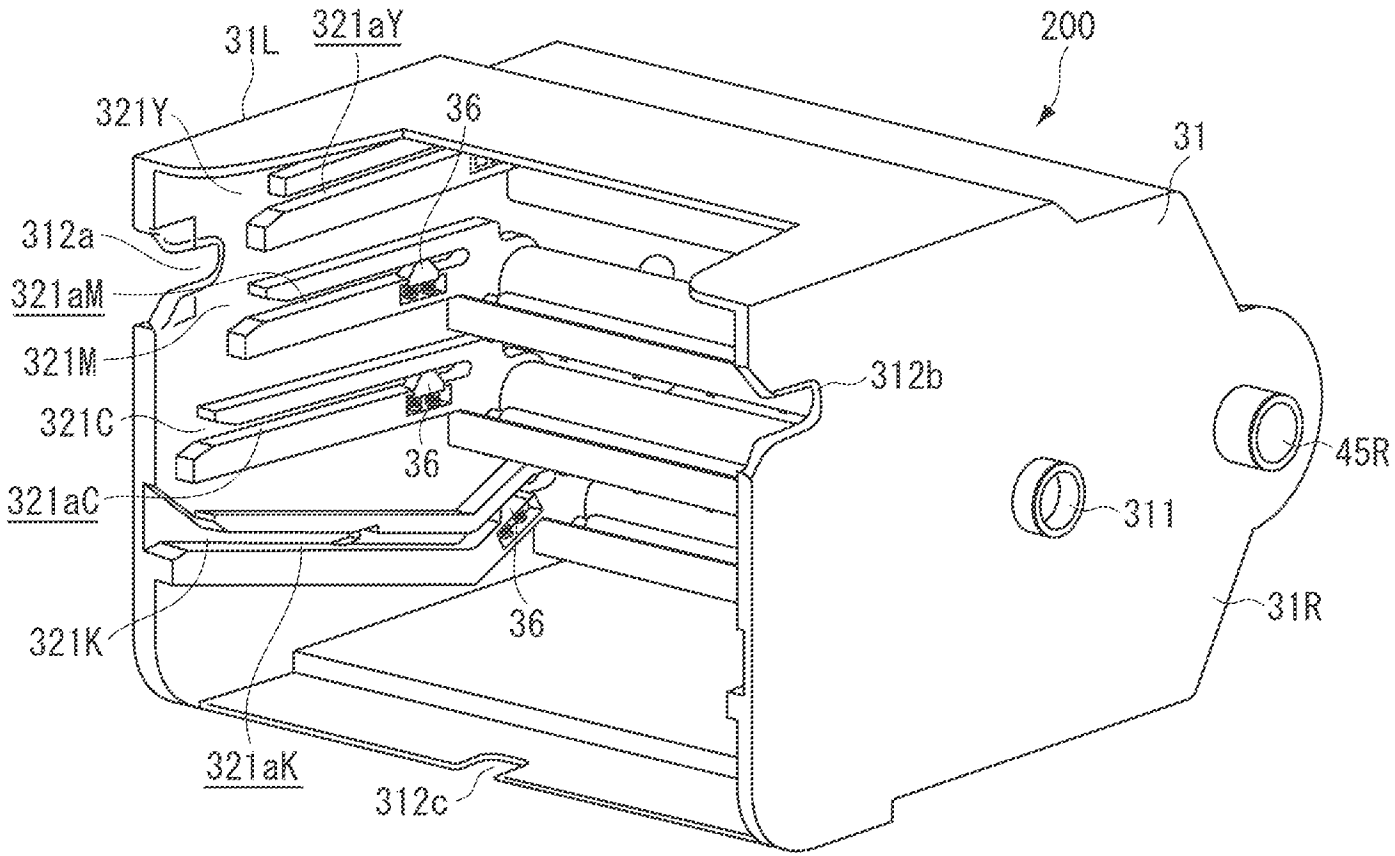
FIG. 14B is a right-hand side perspective view of the image forming unit according to the second exemplary embodiment.

On the other hand, as illustrated in FIGS. 14A and 14B, the sub frame 31 of the image forming unit 200 is provided with attachment guides 321 (321Y, 321M, 321C, and 321K) for attaching and positioning the four developing cartridges.

Figure 15:
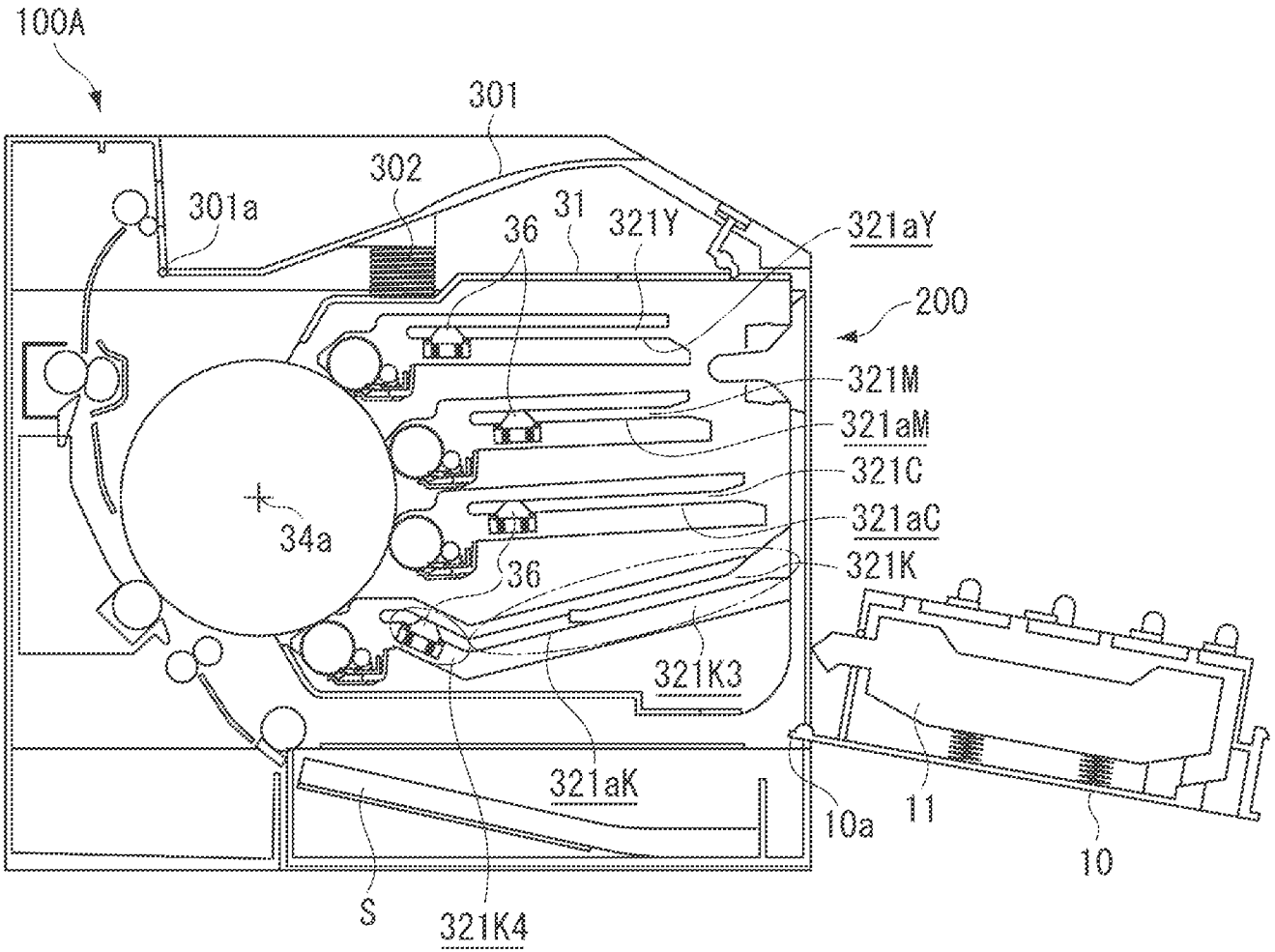
FIG. 15 is a left-hand side longitudinal sectional view of an image forming apparatus main body when a cover unit according to the second exemplary embodiment is at the closed position.

Here, as illustrated in FIG. 15, the configuration of the attachment guides 321K of the cartridge attached to the lowermost stage is such that they first descend from the inlet, whereas the configuration of the other guides 321Y, 321M, and 321C is substantially horizontal. Thereafter, they ascend as they extend toward the depth, with the innermost portions thereof being substantially horizontal.

More specifically, first, the guide surfaces 321*a*K of the attachment guides 321K have portions 321K3 extending away from the guide surfaces 321*a*Y, 321*a*M, and 321*a*C of the attachment guides of the other cartridges in the direction in which the cartridges are adjacent to each other (in the vertical direction in FIG. 15 in the present exemplary embodiment). Further, there exist portions 321K4 extending toward the guide surfaces 321*a*Y, 321*a*M, and 321*a*C of the attachment guides of the other cartridges in the direction in which the cartridges are adjacent to each other.

Further, as illustrated in FIG. 12, on the longitudinal outer sides of the attachment guides 321K, there are provided second guides 321K2 descending from the inlet to become substantially horizontal halfway through the descent before stopping halfway through.

Here, while FIG. 12 depicts the right-hand side guides, similar second guides 321K2 are also provided on the left-hand side.

Further, as in the first exemplary embodiment, in front of the positioning portions of the attachment guides 321K, there are provided regulating members 36. The regulating members 36 are chevron-shaped members; in the free state, they are pushed up by the urging force of urging members 37, and their chevron-shaped portions enter the attachment portions 321K, with the upper surfaces thereof abutting the ceiling surfaces of the attachment portions 321K to be thereby received.

Next, the attachment procedures will be described with reference to FIGS. 13A through 13F. FIGS. 13A through 13F are left-hand side longitudinal sectional views of the image forming apparatus 100 when attaching the cartridge 33K.

Figure 13A:
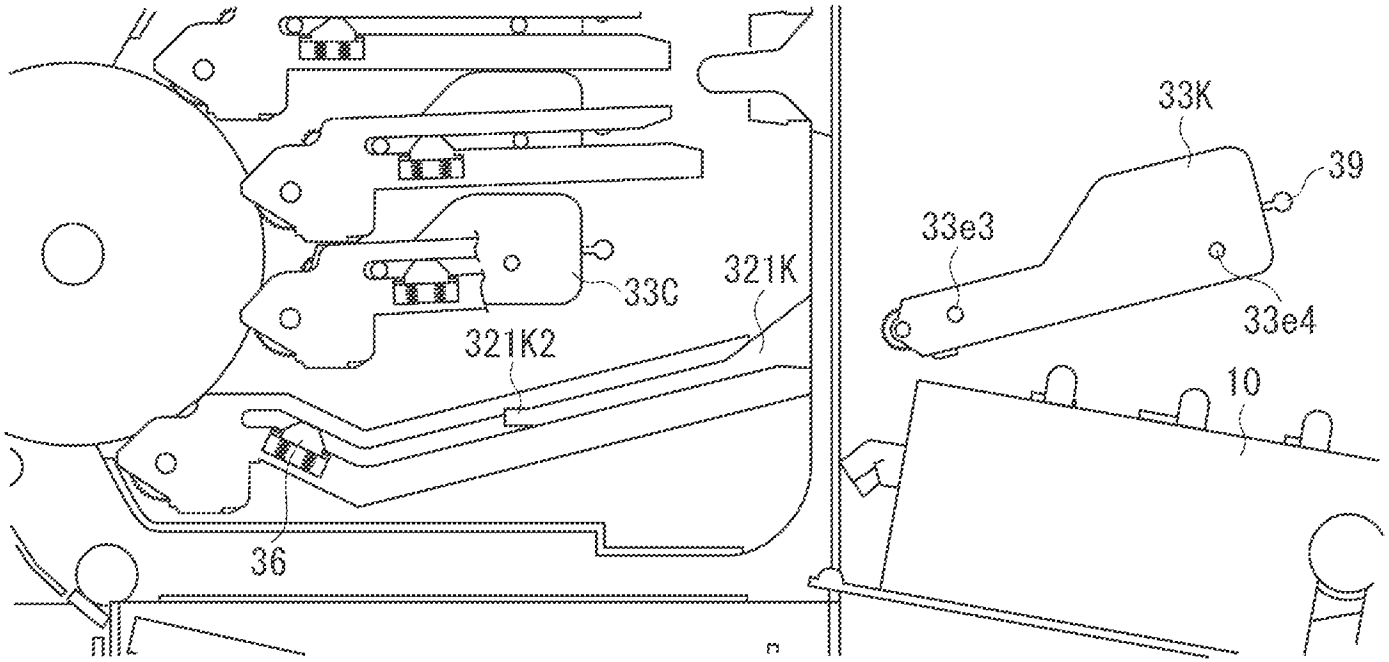
FIG. 13A is an explanatory view illustrating the attachment/detachment of a cartridge attached to the lowermost stage according to the second exemplary embodiment.

First, the cover unit 10 is set at the open position where it opens the opening 100B (FIG. 13A).

Figure 13B:
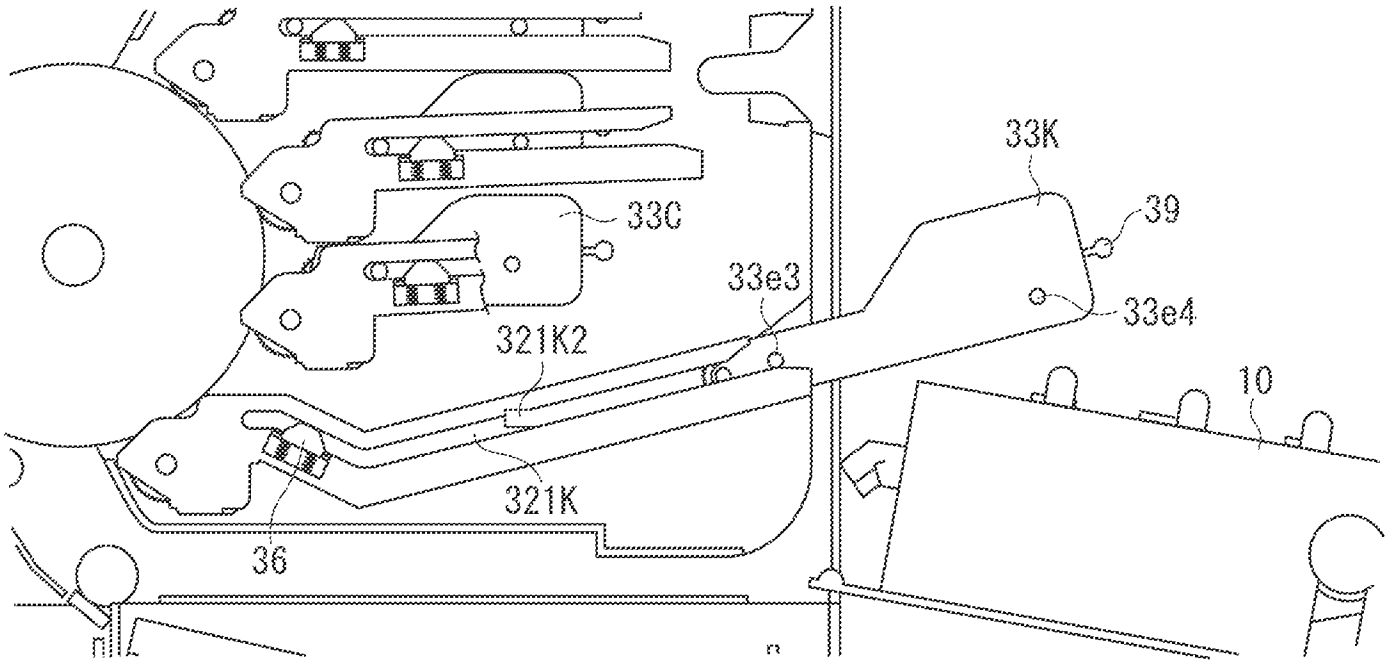
FIG. 13B is an explanatory view illustrating the attachment/detachment of the cartridge attached to the lowermost stage according to the second exemplary embodiment.

Next, a grip portion 39 provided on the cartridge 33K is grasped, and the cartridge 33K is attached to the corresponding attachment portions 321 K of the unit 200. The cartridge 33K is attached from a direction orthogonal to the rotation axis of the developing roller 32*b* (attachment direction). That is, the guided portions 33*e*1 and 33*e*3 on the cartridge 33K side are inserted into the unit 200 side attachment portions 321 K. As illustrated in FIG. 13B, at this time, the cartridge is in a positional relationship which helps to avoid interference with the cover unit 10 and allows insertion without a hitch. While in FIGS. 13A through 13F, of the guided portions 33*e*1 through 33*e*4, only the guided portions 33*e*3 and 33*e*4, which are on the left-hand side, are depicted, the same illustration applies to those on the right-hand side. The guided portions 33*e*1 and 33*e*3 are the first guided portions, and the guided portions 33*e*2 and 33*e*4 are the second guided portions, which are provided on the upstream side of the first guided portions in the cartridge attachment direction.

Figure 13C:
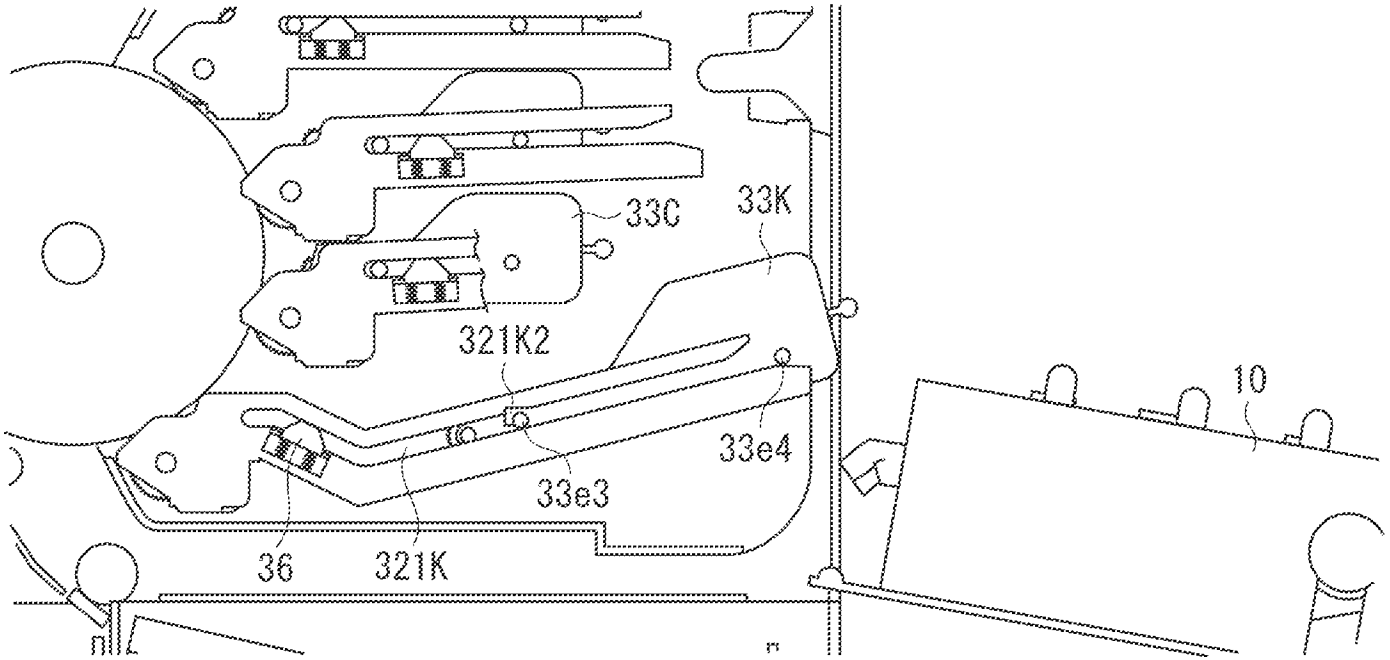
FIG. 13C is an explanatory view illustrating the attachment/detachment of the cartridge attached to the lowermost stage according to the second exemplary embodiment.

Next, as illustrated in FIG. 13C, the guided portions 33*e*1 and 33*e*3 on the side nearer to the developing roller 33*b* reach the substantially horizontal portions of the guides 321K2. The amount by which the guided portions 33*e*1 and 33*e*3 protrude from the cartridge side surfaces (the length thereof in the direction crossing the cartridge attachment direction) is smaller than the protruding amount of the guided portions 33*e*2 and 33*e*4 farther from the developing roller 33*b*. Thus, the guided portions 33*e*1 and 33*e*3 pass as they are regardless of the horizontal portions of second guide portions 321K2. At this point in time, the guided portions 33*e*2 and 33*e*4 enter the attachment portions 321K, so that the inclination of the cartridge is stabilized.

Figure 13D:
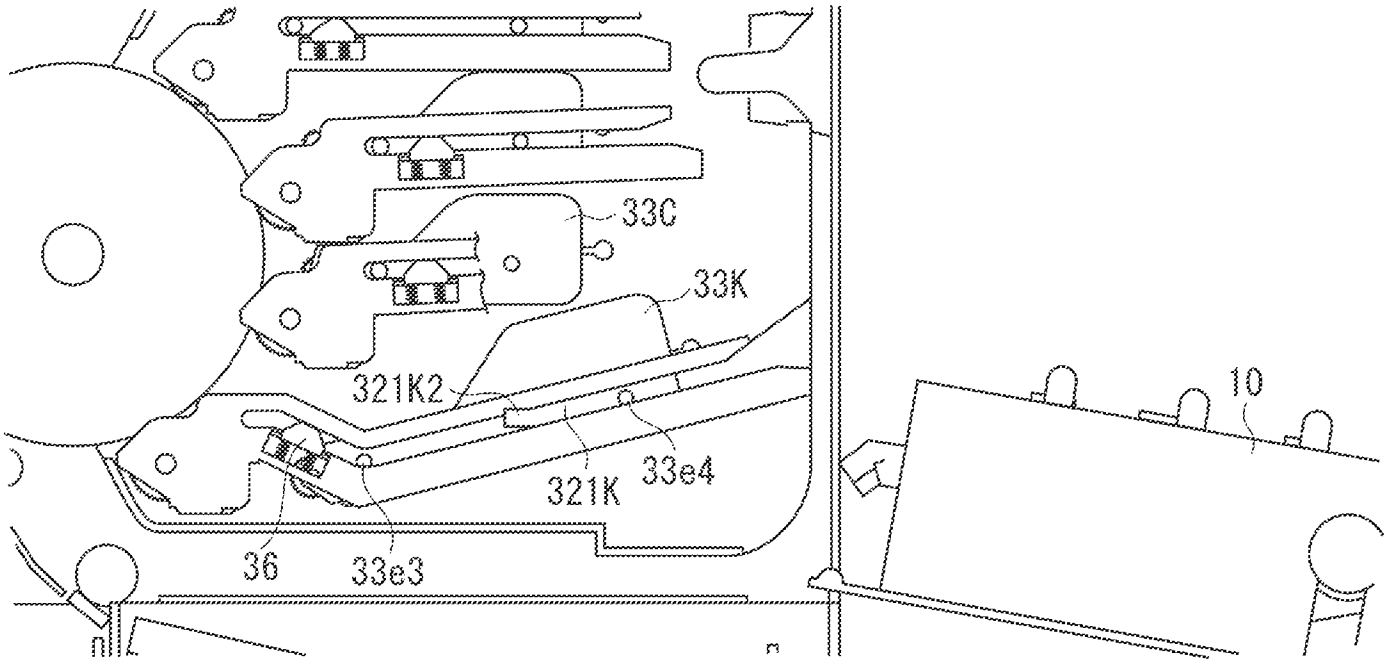
FIG. 13D is an explanatory view illustrating the attachment/detachment of the cartridge attached to the lowermost stage according to the second exemplary embodiment.

When the cartridge 33K is further attached toward the depth, as illustrated in FIG. 13D, the guided portions 33*e*1 and 33*e*3 reach the lowermost portions of the guides 321K. At this time, the cartridge 33K maintains a positional relationship in which it does not interfere with the cartridge 33C directly above it.

Figure 13E:
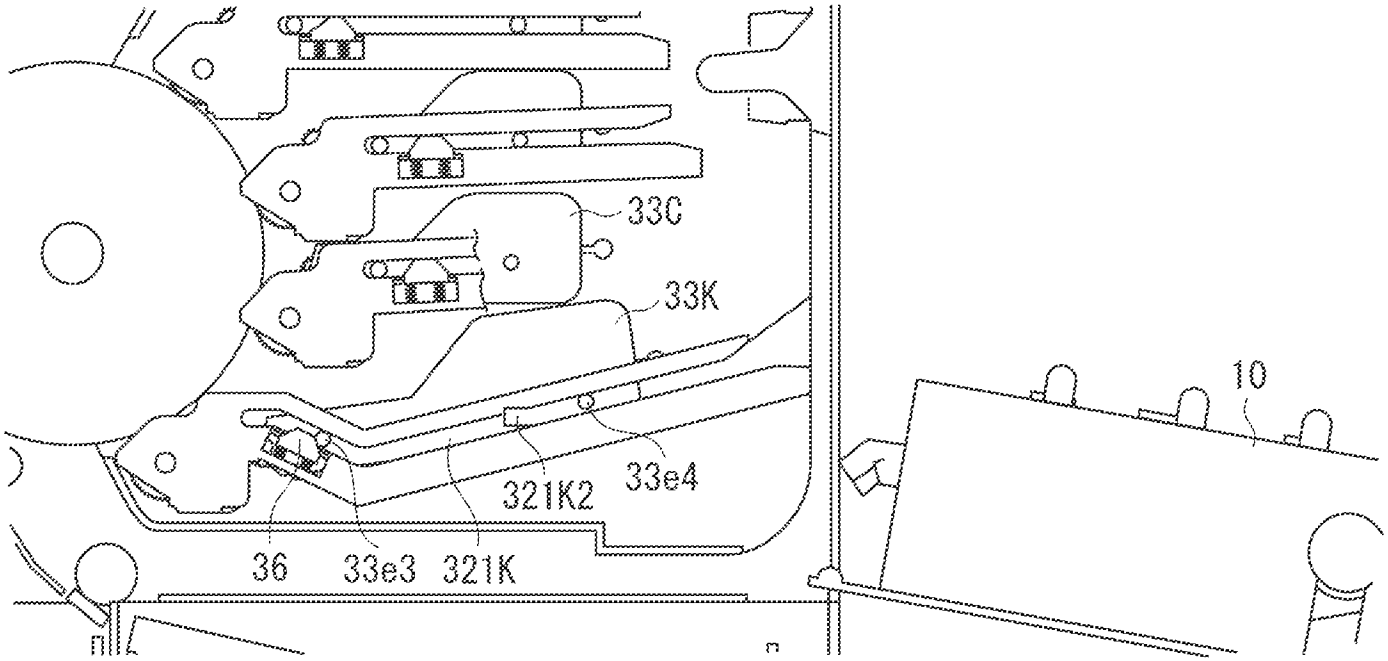
FIG. 13E is an explanatory view illustrating the attachment/detachment of the cartridge attached to the lowermost stage according to the second exemplary embodiment.

As illustrated in FIG. 13E, when the attachment further proceeds, the guided portions 33*e*1 and 33*e*3 move upwardly along the guides, and the rear side guided portions 33*e*2 and 33*e*4 continue to move downwardly, so that the cartridge 33K is attached while changing its inclination. At this time, the cartridge 33K is attached without interfering with the cartridge 33C directly above it. Further, the guided portions 33*e*1 and 33*e*3 are attached while pushing down the regulating members 36.

Figure 13F:
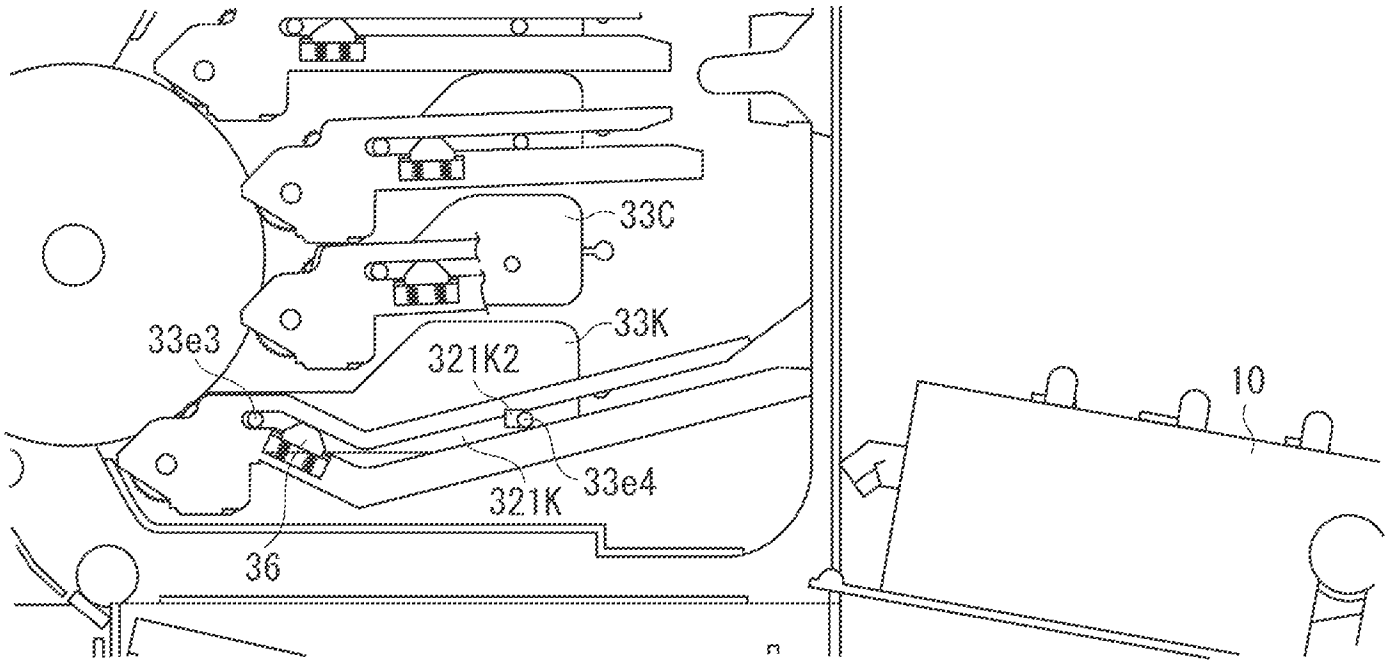
FIG. 13F is an explanatory view illustrating the attachment/detachment of the cartridge attached to the lowermost stage according to the second exemplary embodiment.

Finally, as illustrated in FIG. 13F, the guided portions 33*e*1 and 33*e*3 get over the regulating members 36, and reach the innermost horizontal portions of the attachment portions 321K, whereby the attachment is completed. At this time, the guided portions 33*e*2 and 33*e*4 are engaged with the second guide portions 321K2. As illustrated in FIG. 11C, the amount by which the guided portions 33*e*2 and 33*e*4 protrude from the cartridge side surfaces is larger than the amount by which the guided portions 33*e*1 and 33*e*3 protrude; the former guided portions are engaged with the second guide portions 321K2. Thus, when the cartridge 33K is situated at a position nearer to the depths of the attachment portions 321K than this position, the inclination of the cartridge 33K is substantially horizontal.

Due to the above configuration and construction of the attachment guides, the attachment is easier to perform and an improvement in terms of operability is achieved as compared with the first exemplary embodiment, in which the attachment direction is changed before the rear side guided portions 33*e*2 and 33*e*4 of the cartridge 33K are engaged with the attachment guides 321K.

As in the first exemplary embodiment, also in the present exemplary embodiment, the cartridges 33 are urged toward the corresponding photosensitive drums 32*a* by the cartridge urging members 51*a* through 51*d* of the apparatus main body 100A.

As described above, at this time, the guided portions 33*e*1 through 33*e*4 of the cartridge 33K are situated at the horizontal portions of the attachment guides 321K or the second guide portions 321K2 (FIG. 13F), so that there is no fear of their inclination being changed to become unstable according to the position of the cartridge.

Then, as in the first exemplary embodiment, regulation runners (not illustrated) provided at both ends of the developing rollers 33*b* accommodated in the cartridges 33 are brought into contact with the drums 32*a*, whereby the developing rollers are held in contact with the drums 32*a* with a fixed urging force. The urging force due to the urging members 51*a* through 51*d* maintain a satisfactory contact state (or separation) state between the developing rollers 33*b* and the drums 32*a*.

As described above, in the construction of the present exemplary embodiment, the laser scanner unit 11, which is an exposure unit performing image exposure, is mounted on the cover unit 10, which is a cover member opening and closing the opening 100B for the attachment/detachment of the cartridge, and the cover unit 10 is opened downwardly. In this construction, the attachment guides 321K of the cartridge 33K attached to the lowermost stage have portions extending from the upstream toward the downstream side in the cartridge attachment direction so as to descend with respect to the horizontal direction. Further, they have portions which are on the downstream side of the portions extending to descend in the cartridge attachment direction and which extend so as to ascend with respect to the horizontal direction.

More specifically, the guides 321K of the cartridge 33K attached to the end portions nearer to the cover unit 10 in the open position have portions extending from the upstream toward the downstream side in the cartridge attachment direction away from attachment paths of the attachment guides of the other cartridges. Further, they have portions which are on the downstream side of the portions extending away from the other cartridge attachment portions in the cartridge attachment direction and which extend toward the other cartridge attachment portions.

Thus, the cartridge door is so much the thicker for the attachment of scanner, and even if the lower portion of the cartridge opening is partially stopped in order to achieve a reduction in apparatus size, it is possible to smoothly attach and detach the cartridge to and from the attachment portions nearest to the stopped portion.

Further, it is possible for the attachment direction not to be changed until all the guided portions 33*e*1 through 33*e*4 of the cartridge 33K are engaged with the attachment guides 321K, so that the attachment is easier to perform and it is possible to achieve an improvement in terms of operability.

Thus, a reduction in apparatus size and smoother attachment/detachment of the cartridges are compatible with each other.

While in the above-described first and second exemplary embodiments the exposure unit is provided on the cover unit 10, this should not be construed restrictively. It should be noted, however, that, in the construction in which the exposure unit is provided on the cover unit 10, the thickness of the cover unit 10 is often large. Thus, in this construction, the present invention proves especially effective.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-276168 filed Dec. 10, 2010, which is hereby incorporated by reference herein in its entirety.

What is claimed is:

1. An image forming apparatus allowing attachment/detachment of a plurality of cartridges for forming images, the image forming apparatus comprising:

a plurality of guide units configured to guide the plurality of cartridges to their respective attachment positions for attachment/detachment of the plurality of cartridges, wherein the plurality of cartridges are arranged in a predetermined direction so as to be adjacent to each other, and wherein, at least one guide unit among the plurality of guide units includes an upstream side guide and a downstream side guide, wherein the upstream side guide is positioned on an upstream side of the downstream side guide in a cartridge attaching direction in which the cartridge is attached to the attachment portion, and wherein the upstream side guide is inclined with respect to the downstream side guide such that a cartridge to be attached along the upstream side guide is separated from a guide unit for guiding another cartridge in the predetermined direction.

2. The image forming apparatus according to claim 1, wherein the downstream side guide is inclined with respect to the upstream side guide such that the cartridge attached along the downstream side guide comes near a guide unit for guiding another cartridge in the predetermined direction.

3. The image forming apparatus according to claim 1, wherein the cartridge guided by the downstream side guide and the upstream side guide is equipped with a first guided portion guided by the guide unit and a second guided portion provided on the upstream side of the first guided portion in the cartridge attaching direction, wherein a length of the second guided portion in a direction crossing the cartridge attaching direction is larger than a length of the first guided portion, and wherein the guide unit including the upstream side guide and the downstream side guide is equipped with a guide portion which, when attaching the cartridge, allows the first guided portion to pass and engages the second guided portion.

4. The image forming apparatus according to claim 1, wherein the predetermined direction is a vertical direction.

5. The image forming apparatus according to claim 1, wherein each of the cartridges is a developing cartridge equipped with a developing unit configured to develop an electrostatic latent image formed on an electrophotographic photosensitive member.

6. The image forming apparatus according to claim 1, wherein each of the cartridges is a process cartridge including an electrophotographic photosensitive member and a process unit configured to act on the electrophotographic photosensitive member.

7. The image forming apparatus according to claim 1, further comprising:

a cover member configured to open and close an opening through which the plurality of cartridges passes when the cartridge is attached to the image forming apparatus;

an electrophotographic photosensitive member; and an exposure unit configured to perform exposure to form an electrostatic latent image on the electrophotographic photosensitive member, wherein the exposure unit is mounted on the cover member.

8. The image forming apparatus according to claim 1, further comprising:

a cover member configured to open and close an opening, by rotating, through which the plurality of cartridges passes when the cartridge is attached to the image forming apparatus, wherein the guide unit which is closest to a rotational axis of the cover member in the predetermined direction among the plurality of guide units includes the downstream side guide and the upstream side guide.

9. The image forming apparatus according to claim 1, wherein the cartridge guided by the downstream side guide and the upstream side guide is equipped with a first guided portion guided by the guide unit and a second guided portion provided on the upstream side of the first guided portion in the cartridge attaching direction, and wherein the cartridge changes its orientation by moving in a state that the first guided portion is guided by the downstream side guide and the second guided portion is guided by the upstream side guide.

10. The image forming apparatus according to claim 1, wherein the cartridge to be attached along the upstream side guide moves downward along the upstream side guide.

* * * * *